United States Patent [19]

Kubala et al.

[11] Patent Number: 4,610,206

[45] Date of Patent: Sep. 9, 1986

[54] MICRO CONTROLLED CLASSIFICATION YARD

[75] Inventors: Robert Kubala, Arlington; Anthony LaPolla, Carrollton; Donald Raney; Charles W. Morse, both of Dallas, all of Tex.

[73] Assignee: General Signal Corporation, Stamford, Conn.

[21] Appl. No.: 597,901

[22] Filed: Apr. 9, 1984

[51] Int. Cl.[4] ..... B01B 1/00; G06F 15/48

[52] U.S. Cl. ..... 104/26 B; 104/88; 246/2 R; 364/131; 364/424; 364/436

[58] Field of Search ..... 104/26 B, 26 R, 88; 246/2 R, 167 R, 28 R; 364/131, 424, 426, 436

[56] References Cited

U.S. PATENT DOCUMENTS

| | | | |
|---|---|---|---|
| 3,736,420 | 5/1973 | Elder et al. | 104/26 R |
| 3,844,514 | 10/1974 | DiPaola et al. | 104/26 A |
| 3,861,316 | 1/1975 | Yamazaki et al. | 104/26 R |
| 3,865,042 | 2/1975 | DiPaola et al. | 104/26 B |
| 4,305,556 | 12/1981 | Norton et al. | 246/5 |

FOREIGN PATENT DOCUMENTS

| | | | |
|---|---|---|---|
| 3233666 | 3/1984 | Fed. Rep. of Germany | 104/88 |

OTHER PUBLICATIONS

"Modern Marshalling Yard Developments", *Railway Technical Review* 1973, pp. 11–23, Martin Lung et al.

"An Experimental Application of Microprocessors to Railway Signalling", 1978, A. H. Cribbens et al.

"An Application of Distributed Computer Control of Railroad", *IEEE Transactions,* 8–1980, vol. 27, No. 3, pp. 141–146; Esref Adali.

"Examples of the Future Use of Microprocessors on the DB", 1981, Wilhelm Schwier et al.

"Safe Multiprocessor Microcomputer Systems", 1981, T. Okon et al.

*Primary Examiner*—Randolph A. Reese

*Assistant Examiner*—Donald T. Hajec

*Attorney, Agent, or Firm*—Pollock, Vande Sande & Priddy

[57] ABSTRACT

A modular control system for a railroad classification yard is described. The control system can automatically perform those functions necessary to control the various elements of a railroad classification yard to enable the train of cars to be switched from a hump track to one of a plurality of bowl tracks in accordance with the destination for the car. The control system comprises a number of subsystems including a hump control system (HUMPCON), an operator communications subsystem (OPCOM), a switching control subsystem (MASC), a retarder control subsystem (MARC), a multidrop communications system (MDCOM), a crest monitor subsystem (CMON) and a distance to couple subsystem (MADTC). Some of the subsystems are implemented as singular modules (HCON, OPCOM, CMON). Other subsystems include multiple modules (MARC, MASC, MDCOM). Each module in each subsystem is comprised of a single microprocessor and related peripheral circuits. Data identifying each of the cars to be humped, and the required destination track is provided by OPCOM to HCON. The HCON module tracks the cars as they travel through the yard and maintains a data base indicating control system performance. HCON transfers data to other modules as required via MDCOM. In addition, as information is acquired from other modules, the data base is enlarged to record this information. At the conclusion of switching for a particular car or cut, the resulting data, termed "cut statistics" is transferred to OPCOM for hard copy printout.

32 Claims, 21 Drawing Figures

MARC I/O INTERFACE PCB

MICRO CONTROLLED CLASSIFICATION YARD

DESCRIPTION

1. Field of the Invention

The present invention relates to apparatus for the control of a railroad classification yard.

2. Background Art

The function of the railroad classification yard is one of sorting cars of incoming trains so as to make up out going trains. To this end, a typical railroad classification yard (hereinafter RR class yard) has an incoming track which passes over a hump, and on the downside of the hump, the track passes through a track retarder (the master retarder). At the exit end of the master retarder the single track enters a fan (or throat) switching area which may include a plurality of switches, feeding into a plurality of group tracks, which follow. Each of the group tracks includes a group retarder. At the exit end of each group retarder there is a further switching area including plural track switches feeding into the following bowl (or destination) tracks. Each of the retarders and track switches are associated with presence detectors, wheel detectors, etc. and the retarders are also supplied with velocity sensors. Using information developed by these plural transducers, a control system can determine that a car is approaching a track switch, is presently located in the switching region, has exited a track switch, is approaching a retarder, is in the retarder, has exited the retarder, as well as detecting the instantaneous velocity of a car in and beyond a retarder.

Accordingly, the function of sorting railroad cars is effected by passing a train over the crest of the hump and uncoupling the cars, allowing them to roll freely down the downside of the hump. As the cars roll freely down the downside of the hump, their characteristics, e.g. rolling resistance, weight, etc., is detected by further transducers located in the vicinity of the crest of the hump. The car characteristic, the identity of the destination track, and the available length of the destination track can be used to compute an exit velocity for the car from a (either group or master) retarder to allow the car to roll freely and couple with a preceding car standing on the destination track. With the knowledge of the identity of the car (by its position in the train) and tracking its position through the retarders and track switches, the control system can first accurately control the release of the retarder so as to release the car with the desired exit velocity, and then position the track switches in the path the car so as to route the car to the appropriate one of the bowl tracks. The car's exit velocity is precomputed by processing information respecting the car's destination (e.g. the bowl track, and the length along the bowl track that the car should roll before it will couple to a preceding car on the bowl track), the car's weight, and rolling characteristics. Since two or more adjacent cars in the train may be destined for the same bowl track, such cars may be allowed to roll as a unit or a cut. In general, the control system treats each cut as a separate item to be controlled, and one of the cut's characteristics is the number of cars in the cut.

Although typical RR class yards include a hump track, from the crest of which cars can travel by force of gravity, there are also flat RR class yards. In these yards, a hump engine or the like provides the motive power for cars moving through the yard. While such a yard may not require retarders, the track switch control can still be provided in accordance with the invention.

The earliest examples of RR class yards were entirely manually controlled. That is, an operator located at a control position giving the operator a complete view of the yard, manually controlled the retarders and switches in the path of a car to achieve the desired end result, e.g. allowing a car to roll freely from the hump into its destination bowl track with sufficient velocity to couple to the preceding car in that bowl track, but limiting its velocity so that the car and the preceding car in the bowl track were not damaged by the coupling action.

As it became apparent that some of the operator's functions could be automated, automation was added to the RR class yard. Initially, rather than manually controlling each of the track switches as the car approached the switch, the operator merely punched in the identification of the designated bowl track for the car, and the switching action was semi-automatically effected. Improvements in retarder control coupled with equipment generating distance to go information (the length of track a car had to roll before coupling to the preceding car) allowed retarders to be automatically controlled. Finally, the entire RR class yard was automated by inputting to the control system the consist of the train, identifying each car in the train and the order in which it would be humped, along with a designation of the destination track for the car. In this regard, see U.S. Pat. Nos. 3,844,514 and 3,865,042 disclosing respectively an automatic car retarder control system and an automatic switching control system, both for RR class yards, and both assigned to the assignee of this application.

The control system disclosed in the referenced patents included a mini-computer for automating the retarder control and switching control functions in a RR class yard.

While that technology provides an effective solution to automating RR class yards, it is now apparent to us that improvements can and should be made to that technology.

More specifically, improvements to be described hereinafter result in a simplification of the hardware and software, reduction in the number and extent of signaling paths required for connecting the control system to its various transducers and the like, reducing maintenance burdens and making the system as a whole more easily maintained.

The use of the mini-computer, as exemplified in the referenced patents, necessarily required a centralized control system. This has long been an acute problem since the RR class yard requires an extensive amount of real estate. Centralizing the control system required signal paths for bringing information from transducers dispersed throughout this real estate back to a central point, using the information to generate commands and then additional signal paths for coupling the commands, generated at the centralized point, to the various elements of the control system also dispersed throughout this extensive real estate. In the period since the development of the referenced patents, computer technology has advanced with the development of microprocessors, substantially more inexpensive to purchase, maintain and program, than the mini-computer. Accordingly, one advantage is obtained by substituting a plurality of microprocessors for the mini-computer. In addition to reducing the expense of purchase, maintenance and programming, use of the microprocessors also allows distribution of the control function along the wayside in the RR class yard. A significant bi-product of distributing the control function is the freedom to reduce the length of signal paths by locating a portion of the control system near the element being controlled. Thus, the length of the signal path from a transducer to the control element, and the length of the signal path required to carry the commands back to the element being controlled, is substantially reduced.

Additional advantages accrue from easing the maintenance burdens. By using a unitary control element, i.e. the mini-computer, failure of the mini-computer necessarily interrupted any automatic operation in the RR class yard. In contrast, by using the distributed and separate control elements implemented in the form of different microprocessors, failure of a single microprocessor will not necessarily affect the entire RR class yard, i.e. failures can be isolated. For example, if a microprocessor controlling one of the group retarders fails, the entire RR class yard can continue to be operated automatically except for those tracks affected by the particular group retarder whose control element has failed. In addition to allowing operation to continue, distribution of the control function also eases identification of the failed components, as well as correction of any such failures.

Furthermore, a distributed architecture allows various subsystems to be made independent of each other. In prior art systems the different subsystems existed as different software routines. It was common for information to be passed from a switching subsystem to the retarder control subsystem and back. For applications omitting one or the other of these subsystems, modifications in the software were required. In contrast, an arrangement in which information is derived from a common source for the various subsystems allows the control system to be used even when one of the subsystems is absent. The arrangement also allows the ready integration of an omitted subsystem at a later time. In addition, distributed controls can be independently improved so long as their interface characteristics do not change.

SUMMARY OF THE INVENTION

Accordingly, the inventive control system for a RR class yard includes a hump control module. In this distributed control system, the hump control module is the master or controlling element. This element has access to information respecting the train of cars being humped, through the cooperation of other elements it collects further information characterizing the different cars. The hump control module maintains a data base of cars traversing the class yard, and with access to all of this information it transfers information to other elements of the control system for their use, and monitors the travel of the different cars through the yard. The hump control module includes a single microprocessor.

A second module, the operator communication module includes peripheral circuits for receipt of information respecting a train of cars to be humped. The operator communication module is coupled to the hump control module for transferring at least some of this information to the hump control module. In addition, the operator communication module is responsive to real time operator inputs for controlling the different modes of operation of the RR class yard, including manual, automatic, and semi-automatic. The operator communication module also provides for output reports on system performance. This relieves the hump control module of the burden of retaining information on cars which have reached a destination track. This module includes a single microprocessor. The operator communication module is directly connected to the hump control module for communication therewith.

The RR class yard control system also includes a retarder control subsystem. The retarder control subsystem includes a number of retarder control modules, a single retarder control module is associated with each different retarder (master or group) in the yard (the module itself is identical for a master or group retarder). The retarder control module is responsive to information communicated thereto respecting cars approaching the retarder, and desired exit velocity for the cars, for controlling the associated retarder to effect the necessary velocity reduction for the car. The retarder control module, when a car exits the retarder, can transfer information to the hump control module respecting the car's actual exit velocity. Each such module includes a single microprocessor.

The control system further includes a switching control subsystem which also includes a number of switch control modules. Rather than dedicating a switch control module to each different track switch in the yard, however, each switch control module controls a group of track switches. RR class yards have a set of fan or throat switches between the master retarder all group retarders and groups of switches between all group retarders and all bowl tracks. Thus, there is a different switch control module for each group of switches, both these succeeding group retarders and the single group between the master and group retarders. To effect this control, information respecting any cars which are destined to pass through any of the track switches in a group, is transferred to the appropriate switch control module. The module also responds to transducer inputs enabling the switch control module to track each car as it passes through the group of track switches being controlled. In this fashion, then, the switch control module is capable of positioning the track switches in the group being controlled so as to route each car to its exit track from the group of track switches under control, and finally report back to the hump control module as to the successful/unsuccessful switching operation. Each switch control module includes a single microprocessor.

For purposes of characterizing the cars entering the control system, a crest monitor module is provided in association with transducers located adjacent the crest of the hump. The module is responsive to inputs from the transducers for generating information respecting characteristics and performance of a railroad car or cars. This information is coupled to the hump control module for distribution to other elements of the control system as required. This module includes a single microprocessor.

A distance to couple (MADTC) subsystem may be provided for measuring free length of any bowl track and reporting this parameter to the hump control module. The same subsystem can detect a rolling car and its direction of movement. Typically, the MADTC will report to the hump control module changes in distance to couple for any of the bowl tracks. In the alternative, the hump control module can be provided with DTC information from a software module which subtracts a fixed or specified distance as each car achieves a destination track. This information is referred to as CTG (cars to go). If present as a subsystem, the MADTC subsystem includes a single microprocessor.

Finally, a communication subsystem is provided for implementing a communication link between the hump control module, crest monitor module, retarder control modules, switch control modules and MADTC subsystem (if present). The communication subsystem includes a plurality of communication modules, each module including a separate microprocessor and dedicated communication link. The microprocessor controls the communication link to provide a bidirectional or duplex communication path from/to the hump control module, crest monitor module, retarder control modules and switch control modules.

Typically, each module, whether an operator communication module, hump control module, crest monitor module, retarder control module or switch control module, includes a single microprocessor and associated peripheral circuits. Depending on the function of the different module, the peripheral circuits may be arranged for information gathering, information receipt, or information transmission. In addition, some of the modules perform data processing functions based on information communicated thereto and produce information including commands which may be destined for other modules.

Thus, in accordance with one aspect, the invention provides a control system for a RR class yard including a hump track, a master retarder located in said hump track, a plurality of group tracks connected to said hump track by one or more track switches, each said group track including a group retarder, and a plurality of bowl tracks connected to said group tracks by one or more track switches, said control system comprising:

a. a hump control module for maintaining a data base on RR cars traversing said RR class yard, for receiving information on said cars from other elements of said control system and transferring information to other elements of said control system;
b. an operator communication module coupled to said hump control module for receiving information respecting RR cars and transferring at least some of that information to said hump control module;
c. a retarder control subsystem including a retarder control module for each of said retarders;
d. a switching control subsystem including a separate switch control module for each group of said track switches;
e. a crest monitor module for generating information respecting characteristics and performance of a RR car or cars traversing a crest of said hump; and
f. a communication subsystem comprising a plurality of communication modules for interconnecting said hump control module with said crest monitor module, said retarder control modules and said switch control modules.

Although the invention can be applied to completely automate the functions of a RR class yard, the invention is capable of application in stages, i.e. it is extendible, in an efficient manner, not requiring re-programming of the microprocessor control elements, as different functions are added. Thus, for example, the invention can be applied to the retarder control functions of a RR class yard without necessarily automating the switching control functions (e.g. the switching control functions can be manually or semi-automatically controlled by apparatus outside the inventive control system). Such a restricted control system of course does not include or require the switch control modules. However, each of the other modules may be present. Accordingly, if after installation of such a restricted control system it is desired to increase the comprehensiveness of the system to include the switching function, then it is only necessary to add the switch control modules, the pre-existing modules already in place provide the framework for generating and communicating the information necessary for the switch control modules to function. Accordingly, in another aspect the invention provides a control system for a RR class yard including a hump track, a master retarder located in said hump track, a plurality of group tracks connected to said hump track by one or more track switches, each said group track including a group retarder, and a plurality of bowl tracks connected to said group tracks by one or more track switches, said control system comprising:

a. a hump control module for maintaining a data base respecting RR cars traversing said yard, transferring information to other modules and receiving information respecting RR car position and performance therefrom, said hump control module comprising a microprocessor and related peripheral circuits;
b. an operator communication module coupled to said hump control module, said operator communication module including one or more peripheral circuits for reception of information and a microprocessor responsive to said peripheral circuits for transferring at least some of said information to said hump control module;
c. a retarder control subsystem including a retarder control module for each of said retarders, each of said retarder control modules including a microprocessor and associated peripheral circuits;
d. a crest monitor module including a microprocessor and related peripheral circuits for generating information respecting a particular RR car or cars then traversing a crest of said hump; and
e. a communication subsystem comprised of a plurality of communication modules for interconnecting said hump control module with said crest monitor module and said retarder control modules, each of said communication modules including a microprocessor and a dedicated communication link between said hump control module and at least one other module.

Another important aspect of the invention reduces the part count required to implement the inventive control system. To this end, each different mWocdule (other than HCON and OPCOM) comprises a single or a pair of printed circuit boards. Each module includes a microprocessor circuit board, and some modules include in addition a peripheral circuit board. Although there are as many as seven different modules (operator communication, hump control, multidrop communication, crest monitor, automatic switch control, automatic retarder control and distance to couple), from a hardware point of view there are in fact two different microprocessor circuit boards, and two different peripheral circuit boards. Identity of a particular processor can be assigned by personalization pins located in a back plane. Accordingly, in many cases the function of a particular circuit board is only differentiated by the microprocessor's program. Preferably, the program is implemented as ROM. By personalizing processors based on location, we can use identical ROM's (i.e. all processors carry the entire program). While other embodiments may add one or two more different printed circuit boards, there is a substantial reduction in part count which is a distinct advantage as compared to having different parts for each different module.

In accordance with this aspect, the invention provides a control system for RR class yard including a hump track, a master retarder located in said hump track, a plurality of group tracks connected to said hump track by one or more track switches, each said group track including a group retarder, and a plurality of bowl tracks connected to said group tracks by one or more track switches, said control system comprising:

a. a hump control module for maintaining a data base respecting RR cars traversing said yard, transferring information to other modules, receiving information respecting RR car position and performance therefrom, said hump control module comprising a hump microprocessor and related peripheral circuits, residing on one or more printed circuit boards, b. an operator communication module coupled to said hump control module, said operator communication module including one or more peripheral circuits for reception of information and an OPCOM microprocessor responsive to said peripheral circuits for transferring at least some of said information to said hump control module; said operator communication module including said OPCOM microprocessor located on a printed circuit board, c. a retarder control subsystem including a retarder control module for each of said retarders, each of said retarder control modules including a RET microprocessor and associated peripheral circuits, each said RET microprocessor located on a printed circuit board, d. a crest monitor module including a CMON microprocessor and related peripheral circuits for generating information respecting a particular railroad car or cars, then traversing a crest of said hump, said CMON microprocessor located on a printed circuit board, and e. a communication subsystem comprised of a plurality of communication modules for interconnecting said hump control module with said crest monitor module and said retarder control modules, each of said communication modules including a COMM microprocessor and a dedicated communication link between said hump control module and at least one other module, each of said COMM microprocessors associated with said communication modules located on a printed circuit board, wherein f. said printed circuit boards in said retarder control subsystem, communications subsystem and crest monitor module are identical.

Although a preferred embodiment of the invention employs several backup modules, for switch over in the case an operating module fails, that should not be construed as essential to the invention. Furthermore, the invention can be implemented with less than the number of backup modules described above, or more backup modules. From an operating standpoint, the most crucial back up is the hump control module. Since that module is the hub of the control system, failure of the hump control module can disable the entire system and therefore if any module is to be backed up, the hump control module should be. Only slightly less important from a backup point of view, than the hump control mcdule, is the operator communication module. Since the hump control module does not store the entire consist, failure of the operator communication module during a humping operation, can bring the control system to a halt, for the reason that the hump control module would be incapable of perceiving identification characterizing the destination track of the next car over the hump. Accordingly, the next most crucial backup is the operator communication mcdule. The crest monitor module and throat area automatic switch module are also vital in that a failure could shut down humping operations.

Back-up of the remaining modules is considered less important. Indeed, it would appear entirely adequate to provide no hardware backup for any of these other modules. Rather, if a module fails, the entire PC board or boards can be replaced.

In respect to communications, preferably the communication links between operator communications and hump control is full duplex, master-master, point-to-point. Similarly, the communication relationship between the hump control module and each of the communication modules will also be master-master, point-to-point and full duplex. On the other hand, the relationship between the communication modules and their attached subsystem modules will be half duplex, master-slave, multidrop link. Preferably, the communication module will poll (using a conventional protocol) the attached subsystem modules for reporting change in status (that is for relaying messages from attached subsystem modules, back up to hump control). In the other direction, of course, messages are directed to the specific subsystem module which is concerned with the information being transmitted. For convenience, there are two serial highways, each with a backup. Each serial highway is associated with a different communication module, however a communication module can access either the associated serial highway or the backup.

BRIEF DESCRIPTION OF THE DRAWINGS

The present invention will now be further described so as to enable those skilled in the art to make and use the same in the following portions of the specification, when taken in conjunction with the attached drawings, in which like reference characters identify identical apparatus and in which:

FIG. 6: OPCOM (operator communication)
FIG. 7: CMON (crest monitor)
FIGS. 8–16: HCON (hump control)
FIG. 17: MASTER MARC (retarder control)
FIG. 18: Throat MASC (switch control)
FIG. 19: Group MARC (retarder control)
FIG. 20: Group MASC (switch control)
FIG. 21: MADTC (distance to couple).

DETAILED DESCRIPTION OF PREFERRED EMBODIMENTS

Figure 1:
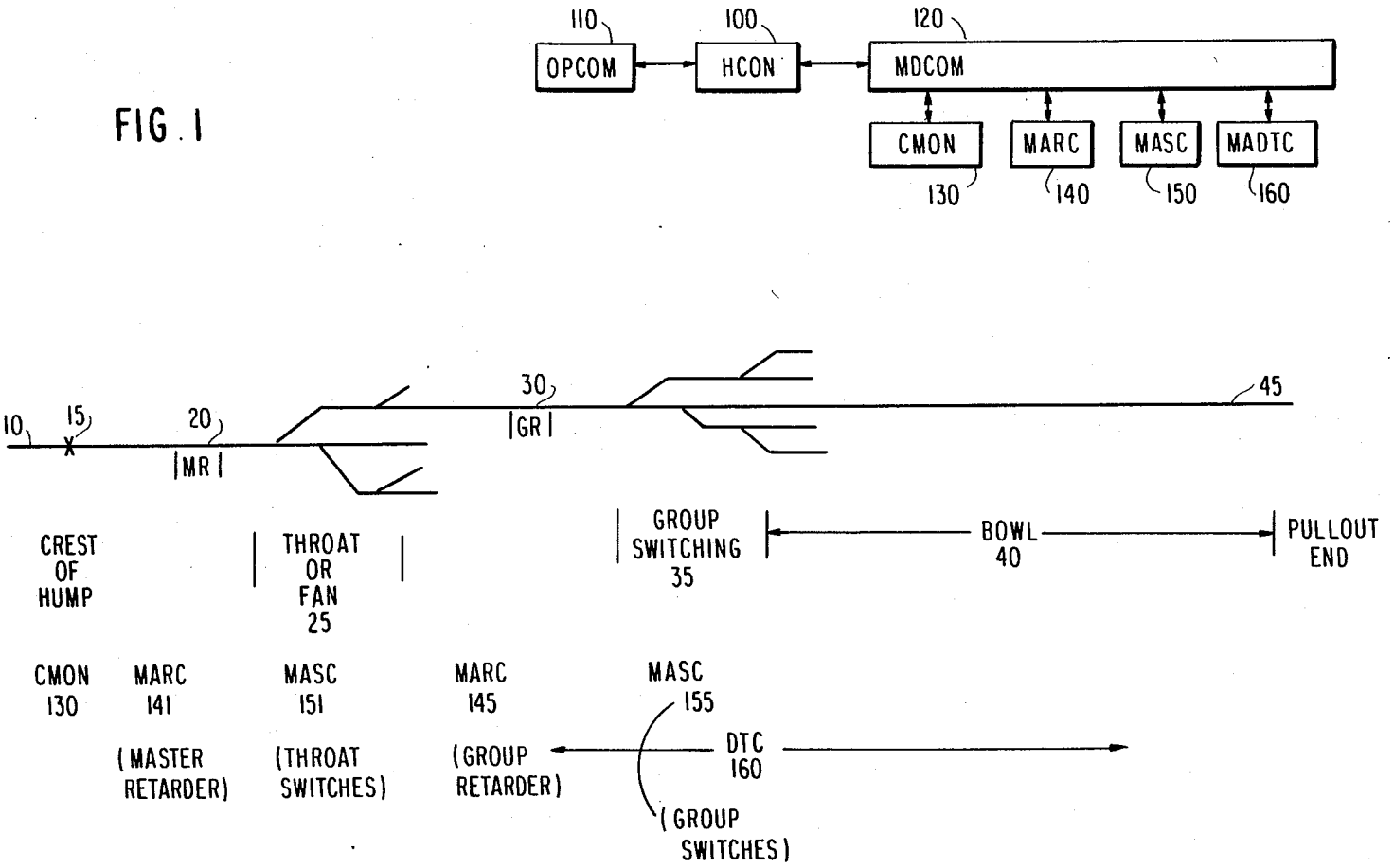
FIG. 1 illustrates significant portions of a typical RR class yard and the relationship therewith of subsystems of the present inventions.

FIG. 1 shows one typical path through a RR class yard, other similar paths are not illustrated for convenience. The particular path begins at an entrance end 10, continues past the crest 15 of a hump, and on the downside of the hump passes through a master retarder 20. The typical path then enters the throat or fan area 25 including a plurality of track switches. After the throat or fan area 25, the typical path traverses a group retarder 30, and enters a group switching area 35. The group switching area 35 also includes a plurality of track switches. Following the group switching area 35, the typical path enters a bowl area 40 and finally the typical path terminates at the pull out end 45. Those skilled in the art will understand that other substantially identical paths exist through the RR class yard, for receiving and storing railroad cars being sorted for the purpose of making up out-bound trains.

In accordance with the invention, the control system for the yard is broken up into a number of different subsystems. For example, in the upper portion of FIG. 1, communication between seven of the various subsystems is illustrated. More particularly, the hub of the entire control system is the HCON (hump control) subsystem 100. This subsystem communicates with the OPCOM (operator communication) subsystem 110. HCON also communicates with MDCOM (multidrop communications) subsystem 120. This latter subsystem communicates, in turn, with CMON (crest monitor) subsystem 130, MARC (microprocessor automatic retarder control) subsystem 140, MASC (microprocessor automatic switch control) subsystem 150 and MADTC (microprocessor automatic distance to couple) subsystem 160.

Each of the subsystems includes at least one dedicated module, some subsystems include a plurality of modules. Each module includes a microprocessor. Also indicated in FIG. 1 is the general region of interest for several of the subsystems. For example, CMON 130 is dedicated to deriving information in the region of the crest 15. The automatic retarder control system 140 includes a number of modules, one of them, MARC 141, controls the master retarder 20, and in addition derives information from transducers in the region of the master retarder 20 which is used by other subsystems. Similarly, the automatic switching control subsystem 150 includes a module MASC 151 which controls the switching in the throat or fan region 25. This subsystem also derives information from this region for use by other subsystems. Similarly, the automatic retarder control subsystem 140 includes a module MARC 145 which is used to control a typical group retarder 30, and also derives information from the region of the group retarder 30. In a like fashion, the automatic switching control subsystem 150 includes a module MASC 155 for controlling the switching in the group switching area 35. The distance to couple subsystem 160 monitors the distance between the bowl track tangent point (in FIG. 1 the junction of regions 35, 40) and a preceding car on the bowl track to which a particular car is destined to travel. This parameter, as is known, is used in computing the desired exit speed of the car from the group retarder 30.

Mention has been made, in the preceding, of sensing information, and as is apparent to those skilled in the art, typical RR class yards include a host of sensing transducers such as weigh rails, wheel detectors, presence detectors, etc. Railroad car velocity may be sensed by radar apparatus or other velocity sensor, retarder position is determined by still other sensors. In order to appropriately control the RR class yard, information must be derived from a variety of these transducers and funneled in at the appropriate times for application in a variety of algorithms used in determining appropriate commands, e.g. switching commands for track switches, retarder positioning commands, etc. In addition to sensing this real time information, another important input to the control of a RR class yard is the consist. The consist is a list of the cars that are to be sorted, in the order in which they will appear at the crest 15 of the hump. Typically, this information is key punched or otherwise communicated electronically, and it is from the consist, and more particularly the ultimate destinations for these cars, from which the destination track or bowl track for each car will be determined.

Accordingly, the control problem is one of sensing real time events, e.g. a new car positioned at the top of the hump, determining the parameters of the car, e.g. the number of axles, its weight, its rolling characteristics and its destination track so as to allow application of known algorithms to determine desired exit speed of the car so that it will properly couple when it reaches its destination track, along with generation of appropriate switching commands to position the track switches as the particular car approaches them, to enable the car to reach its desired destination track.

Figure 2:
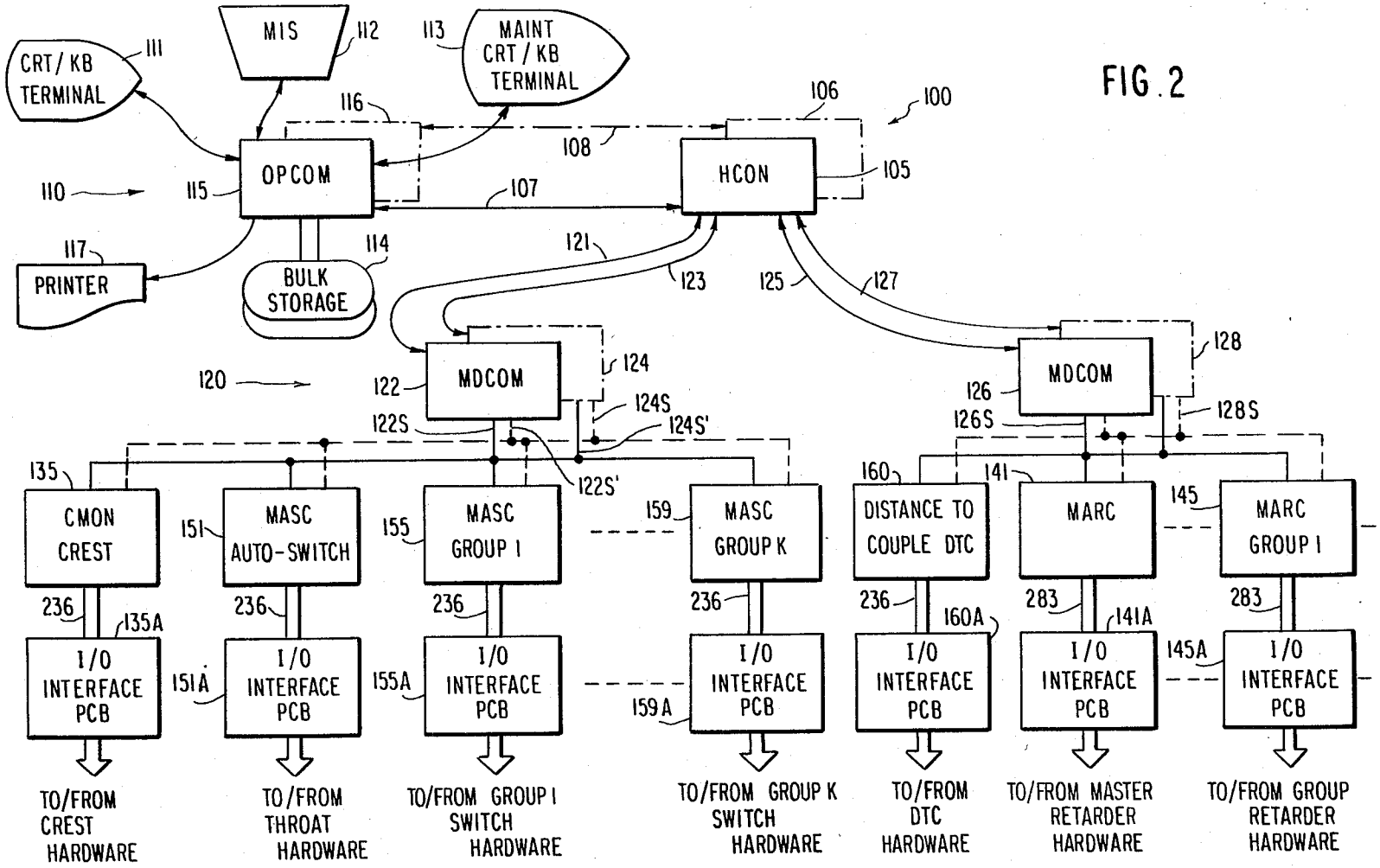
FIG. 2 is a block diagram illustrating the relationship between various subsystems, and the elements comprising different subsystems.

FIG. 2 is a module level diagram illustrating the different modules contained in the various subsystems, and the manner in which the subsystems interconnect with one another. As shown in FIG. 2, the OPCOM subsystem 110 includes an OPCOM module 115, coupled via dedicated communication links with peripheral equipment such as a CRT/KB (cathode ray tube, keyboard) terminal 111, MIS (management information system interface) 112, MAINT. CRT/KB (maintenance cathode ray tube, keyboard) terminal 113, bulk storage 114 and printer 117. The main purpose of the operator communication subsystem is to enable two functions to be performed; the first function is to allow an operator to interface with the system for control purposes, e.g. determine a system mode of operation which in turn determines the functions that the system will implement in the different modes, and secondly to input the consist to identify the various cars in a train, and the order in which they appear. Although FIG. 2 implies that the consist will be keyboarded into the control system via the operator communication subsystem, those skilled in the art will understand that, rather than keyboarding this information it could be communicated from a remote location. The operator communication subsystem also provides for system output in the form of printed reports, display of current information and interfacing with a management information system. The bulk storage supports these various functions by providing storage in excess of that available in electronic memory.

As should be apparent from FIG. 2, the HCON subsystem 100 is the hub of the entire control system in that any information required by a subsystem which is not generated in that subsystem is communicated to that subsystem through the HCON subsystem 100. As indicated in FIG. 2, the primary component is an HCON module 105 which includes a dedicated microprocessor. HCON 105 is provided with a dedicated bidirectional communication link 107 to OPCOM module 115. Communications to other subsystems is carried out through the MDCOM subsystem 120, and in particular MDCOM modules 122 and 126. Each of these modules includes a dedicated bidirectional communication link with HCON module 105 and links 121 and 125 effect this function.

The other subsystems (e.g. subsystems other than HCON 100, OPCOM 110 and MDCOM 120) are coupled to either one of two bidirectional serial data highways; MDCOM module 122 is coupled to the CMON subsystem 130 and ASC subsystem 150 via the serial highway 122S, and MDCOM module 126 is coupled to the DTC subsystem 160 and the ARC subsystem 140 via the serial highway 126S.

In particular, serial highway 122S is connected to the CMON subsystem 130 including the CMON module 135. Highway 122S is also connected to the ASC subsystem 150 which ihcludes the MASC module 151 and a different module for each group of track switches; FIG. 2 illustrates two typical modules MASC 155 and MASC 159. MDCOM module 122 is also connected to parallel serial highway 124S, so that module 122 can use either of the serial highways 122S or 124S for communications.

On the other hand, serial highway 126S is connected to the DTC subsystem 160 including a single DTC module. The same serial highway is connected to the ARC subsystem 140 including an MARC module 141 (controlling the master retarder 30), and a different module for each group retarder; FIG. 2 illustrates a single MARC module 145. Likewise, module 126 has available to it a parallel serial highway 128S. This division of some modules on serial highway 122S and others on serial highway 126S is for convenience. In similar systems, a single serial highway would suffice. Preferably, we connect no more than 18 modules per serial highway.

Typically each module includes (at least) a pair of printed circuit boards, one housing a microprocessor and its direct support circuits, and a separate board housing I/O interface circuits to/from field hardware. As will be seen below, during a discussion of a detailed block diagram of the I/O PC boards, provision is made for digital as well as analog inputs and outputs. Digital inputs will typically consist of relay position information indicating the condition of output relays associated with different transducers, e.g. cut length detectors, wheel detectors, presence detectors, analog and/or position sensors, track switch position repeaters, etc. Digital outputs can be used to throw track switches, position retarders, etc. On the other hand, retarder pressure is sensed in analog form.

FIG. 2 also illustrates back up equipment which is available for substitution in the case of failures. More particularly, the OPCOM module 115 is backed up by a counterpart OPCOM module 116. Likewise, the HCON module 105 is backed up by the HCON module 106. These back up modules 106 and 116 include a dedicated bi-directional communication link 108. The MDCOM modules 122 and 126 are also backed up by MDCOM modules 124 and 128. Each of these latter modules include their own dedicated bi-directional links to HCON module 105, in particular links 123 and 127. Thus, as illustrated in FIG. 2, the backup HCON module 106 is not in communication with the MDCOM subsystem. Rather, the links 121, 123, 125 and 127 are switchable between the module 105 and 106. While this switching can be automatically initiated, preferably the switching operation is manual.

The backup MDCOM module 124 is connected to both serial highways 122S and 124S. Similarly, the backup MDCOM module 128 is connected to both serial highways 126S and 128S. Because of the MDCOM module arrangement, module 122 can communicate with its back up 124, and likewise module 126 can communicate with its back up 128.

Subsystem Descriptions

I. HCON—Hump Control

HCON is the communications switching center of the system. Every configuration must have it. HCON interprets all incoming messages, makes note of the information in a data base it maintains, and dispatches the message to any further destination(s).

HCON is not the system tyrant. It is not the repository of detailed information concerning retarder state or exact position and speed of each cut in the yard. These are the affairs of the subsystem concerned with the related activity. But HCON's data base does contain adequate information on traffic, yard mode, blocked groups, blocked tracks, etc. for HCON to be able to "intelligently" control the message flow required for correct subsystem action, i.e. supervise the controllers of the various zones.

Inputs

Cut characterization parameters as a cut transits the crest 15 from CMON.

Yard equipment status reports per request and on a "change in status" basis from other subsystems.

Traffic/handling reports from subsystems (switching, retarder) as traffic is received by the subsystem, as it departs, and for any exceptional circumstance.

Processing

Initializes all subsystems to a safe state on initial power-up. Leads individual modules to an active state as they come on-line from a maintenance status.

Interprets messages inbound to itself in order to continue the message content on to the various required working destinations—while gleaning information from those messages in order to (1) maintain current status of yard equipment, and (2) the state of the traffic, at least to the resolution of knowing in which modules control zone the traffic currently is.

Outputs

Yard mode.

Message packets containing traffic control information to switching, retarder subsystem, crest monitor subsystem, and OPCOM subsystem required to permit proper action as traffic enters the subsystem control area.

Alarms.

Report information.

Check-point information if present to a back-up HCON.

II. OPCOM—Operator Communications

Interprets and displays on each CRT the KB input from the operator on a per terminal basis. OPCOM composes messages on the basis of such input which then become commands to the system (e.g. change yard mode, enter cut information), or requests to display on the terminal information contained in the system. These messages are given to HCON which determines, in control system terms, what needs to be done.

When data is given to OPCOM from the system (i.e. from HCON) either because a report is in order (e.g. alarm), or in response to a display request initiated at a KB, OPCOM must format that data and otherwise make it ready for display on the proper CRT (or printer).

OPCOM does maintain information such as the consist and does accumulate report information such as 'cut stats' (cut statistics) which are likely to be printed or delivered to an external MIS at some point. In contrast HCON and the switching subsystem are concerned only with traffic currently moving in the yard (crest to tangent point), and current yard equipment status. HCON regularly dumps cut stat information over to OPCOM (when HCON is through with control of that cut).

Aspects of system security (i.e. which terminal has what features), and matters of operator command/request composition and editing, are OPCOM's exclusive responsibility—i.e. are not the concern of HCON.

There are alternative forms of OPCOM. In small yards, there may be no CRT terminal—just a "control machine" with switches, potentiometer, and digital number displays. Such a version of OPCOM will not have the full repertoire—but of those commands that exist in that application level, communication with HCON will take exactly the same messages and message contents as for the CRT terminal versions of OPCOM.

Inputs

CRT terminal KB strokes and command lines.
(Alternately) Control Machine pushbuttons, dials, and levers.
Inventory and performance data (from control of cuts).
Table parameters and status tables (from control system internals).
Track distance to couple (unless there is a DTC module 160—see FIG. 2).
Hardware faults and alarms.
Consist list car records (from operator CRT or MIS).
Notice of cut entering/backing out of the system.
Mode change command.
Request for data displays.
OPCOM requires access to equipment status and distance-to-couple.

Processing

All operator interface equipment is monitored by OPCOM.
Report information such as Faults, Alarms, Inventory, and Performance data is made available to operators.
When a cut enters or backs out of the control system, OPCOM requires confirmation to adjust the consist list accordingly.

Outputs

Requested Destination track.
Block track/switch.
Reports and fault logs.
Access to table parameters (rollings resistance, etc.).
CRT display response.
Mode of humping operation.
Hump performance data.

III. MARC—Automatic Retarder Control

This subsystem will control both the GRS type E160 electrically actuated retarder mechanism the GRS E160 (converted to hydraulic) and the WABCO air operated retarder mechanisms.

The retarder module provides for:

(1) electric, hydraulic or air retarders will be accommodated with one hardware/electrical design.
(2) application of the module to various yards and retarder equipment complements (track circuit, PDs, photocells, etc.), grades, and specific equipment positioning will be accommodated without reprogramming, i.e. application variables are restricted to DIP switch settings and EPROM description tables which will be segregated from the control program.

Input

Mode of hump operation required by system.
Information required to handle cut: sequence number; weight; desired exit speed; axle count.
Information from retarder equipment required to control cut: radar speed; cut occupancy of retarder (track circuit, wheel-detectors, light detectors).
Manual override indications (override, application of press.).
Semi-automatic speed selects.

Processing

Monitoring/diagnostic of retarder equipment and "sanity" of the module itself.
Maintenance of retarder in a "safe" state while waiting for action on a cut.
Accurate and efficient control of a cut given information characterizing the cut and radar measurement of cut speed.
Timely and accurate communication with the remainder of the system.

Output

Position commands for control of retarder mechanism.
Report on how cut was handled including exit speed, state of equipment during control, whether manual override, etc.

IV. CMON—Crest Monitor

This module determines that cuts have entered or backed out of the control system for control purposes. CMON informs HCON that a new cut has entered or backed out and CMON characterizes the cut for use by other subsystems through the measurement of cut weight, height, and number of axles.

CMON contains bi-directional wheel detectors in its equipment complement so as to be able to detect reverse (up-hill) motion of a cut to update the number of axles which have entered and departed the crest from the lead track.

CMON accommodates 'reasonable' variations in crest equipment to be found in yards and reasonable variations in equipment placement.

A test section near the crest 15 is composed of two or three wheel detectors (WD). Cut acceleration is calculated from the transit times of the cut axles at these detectors. This logic is also sensitive to failures in the detectors.

Inputs

Request for status.

Field inputs from crest bi-directional WDs, test section WDs, weigh rail, long cut photo-detector, dragging equipment detector, broken flange detector, etc.

Processing

Monitors attached I/0 to detect signs of faulty operation, and disconnection of equipment.

Watches for arrival of fresh cut; and for possible retrograde motion of a cut which has arrived.

Processes the I/0 readings (which are carefully time-stamped) in order to construct the physical characteristics of the cut.

Processing of test section wheel detector transit times to determine rollability of cut and possible wheel detector fault.

Outputs

Cut characterization sets off chain of events to control a cut toward the bowl track. Contains number of axles, weight of cut, bulkhead height, and whether motion is forward or reverse.

V. MASC—Automatic Switching Control

The MASC modules (one for the 'throat' and one per 'group' switching area) performs the cut tracking and switch control function. Switch I/0 connects directly to these modules.

The essentials of switch processing (tracking of traffic, and control of the switch machines) is done in these modules, not in HCON.

Physically, the switching subsystem is composed of the appropriate collection of MASC modules which interact with a communications subsystem unit (MDCOM) which is responsible for control of the serial highway (also called a 'multidrop' serial line).

Two types of switching are available. One type (old relay system emulation with enhancements) calls for a direct and rather simple operator directed setting of routes. Unusual happenstances such as catch-up are handled by operator intervention.

The other category is completely automatic with full cornering prevention and will require that wheel detectors be installed at the front of each switch.

Inputs

Switch points, presence detectors (PDs), clearance track circuits (CTCs), wheel detectors (WDs), i.e. yard hardware status.

Incoming traffic messages, i.e. HCON informs MASC of traffic to expect, the intended bowl track, and characteristics of the traffic.

Processing

Queues up information on anticipated traffic.

Tracks traffic through the switching zone (throat or group).

Sets switches as cuts approach (according to intended target track, but having safety [cornering prevention-]as preemptive priority).

Monitors hardware input signals against switch commands and movement of traffic in order to detect faulty hardware.

Outputs

Switch position commands (i.e. switch control).

Reports messages to the system telling of cut positions and speeds.

Status reports on switch, CTC, PD, and WD hardware.

Check-point information of use to potential back-up switching controller.

VI. DTC—Distance to Couple

Measures, upon specific command, and by scanning, the distance between the tangent point and axle of the last cut to enter the bowl track, for each bowl track in the yard.

An alternate form of DTC maintains a count of the number of 55 foot car lengths available on each bowl track. The algorithm performing this car count will be in the OPCOM subsystem. As each car exits a final switch HCON informs OPCOM and OPCOM will decrement the track's corresponding count. This count can be displayed, per operator request, via the OPCOM subsystem. The operator will be expected to make any major modifications to this count to compensate for stalls and pull-out.

FUNCTIONAL PROCESSING IN THE "HUMP" MODE

The control system will be governed by major modes established by RR operations personnel through the OPCOM subsystem. These modes IDLE and HUMP, for example, correspond to the major yard modes. In addition, an INITIALIZATION mode is briefly entered when power is first brought to the control system hardware.

IDLE inactivates most control system functions (tracking of cuts, monitoring of the crest, update of practically all of the reporting functions, etc.) but does call for retarders to go to their rest position.

HUMP mode is the most complex mode and the one in which the work of the yard is primarily accomplished and therefore will be described in detail.

STATE DEFINITIONS (HUMP mode):

During the "HUMP" mode the Hump Control module coordinates humping activities based on the following defined states.

State 1: New Car Entering Control System Area

Defined as that time when the first truck of a new car has traversed the downhill forward directional wheel detector located at the crest.

State 2: Crest Characterization of New Car

Defined as that time when the second truck of a new car has traversed the downhill forward directional wheel detector located at the crest. Note that this car can be part of a multi-car cut.

State 3: Test Section Characterization of Cut

Cut has travelled sufficiently through test section area, on the hump lead, to be further characterized.

State 4: Cut Enters Master Retarder Control Area

The expected cut has arrived at the master retarder. This arrival is indicated by the cut's first axle actuation at the retarder entrance wheel detector or by the front of the cut breaking the retarder entrance light detector beam or by the cut occupying the track circuit (if field equipment is interfaced).

State 5: Cut Exits Master Retarder And Enters Fan Switching Area

A cut has exited from the retarder when the cut's last axle is indicated by the retarder exit wheel detector (also called switch wheel detector) or when the rear of the cut moves through the retarder exit light detector or track circuit.

The cut has entered the switching area when
1. the cut's first axle is detected by switch wheel detector,
2. or the switch presence detection hardware indicates occupancy,
3. or when the retarder exit light detector (plus some delay) shows occupancy.

State 6: Cut Exits Fan Switching Area
This is defined as that point where the direction (i.e. to which group) the cut is heading is known. This point will most probably be when the final switch, to be traversed by this cut, is positioned and that position verified.

State 7: Cut Enters Group Retarder Control Area
Similar to State 4, at a group retarder.

State 8: Cut Exits Group Retarder And Enters Group Switching Area
Similar to State 5, at a group switching area.

State 9: Cut Exits Group Switching Area
The cut has been routed through a final switch and is occupying the track's clearance track circuit.

FUNCTIONAL PROCESSING IN THE VARIOUS STATES (phases) OF HUMPING

State 1
1. CMON senses car entering control area and gathers information about the first half of the car.
   truck axle count
   truck weight class
   whether 1st, 2nd, . . . car of a multicar cut
2. CMON informs HCON about the new car.
3. HCON assigns a "car" sequence number to identify this car. HCON also allocates a record block, in the data base, to maintain information gathered on this "car/cut".
4. HCON informs CMON of the assigned sequence number for this car.
5. HCON informs OPCOM that a car has entered the system.
6. OPCOM will advance the hump list display, if one exists.
7. OPCOM informs HCON of the crest assigned destination track for the car.

State 2
1. CMON completes crest characterization for the "car".
   car axle count
   car weight class
   car height class
   car overhang length
   multicar cut status (i.e. if part of a multicar cut, is it 1st, 2nd, . . . car)
2. CMON informs HCON of crest characterization.
3. HCON updates this "car's" record block with all information gathered during this state.
4. If this is the first car of a multicar cut HCON informs the MARC module for the master retarder of this potential "cut". If not first car then HCON informs the MARC module for the master retarder to update parameters of the potential "cut" (# axles, weight, etc.).
5. If this is the first car of a multicar cut HCON informs the MASC module for the throat switching area of this potential "cut". If not first car then HCON informs the MASC to update parameters of the potential "cut" (# axles, weight, etc.).
6. HCON prepares for checkpointing performance of processing of MARC and MASC modules (i.e. States 4 and 5).

State 3
1. CMON finalizes crest characterization with the test section characterization.
   "cut" rollability
   "cut" wheelbase length, if possible
   long cut status
   "cut" weight in tonnage, if weigh-in-motion scale interfaced.
   "cut" weight class, otherwise.
2. CMON informs HCON of final test section characterization.
3. HCON updates this "car/cut" record block with all information gathered during this state.
4. HCON invokes the Exit Speed Calculator routine to compute this cut's desired exit speed from the master retarder.
5. HCON informs the MARC module of this cut's desired exit speed from the retarder.
6. HCON informs (reaffirms) the MASC module of this cut approaching and supplies any newly gathered information.
7. HCON updates checkpointing of MARC and MASC.

State 4
1. MARC informs HCON that the cut has arrived at the master retarder.
2. HCON updates cut tracking records and checkpointing.

State 5
1. MARC informs HCON that the cut has exited the master retarder.
2. MASC informs HCON that the cut has entered the fan switching area.
3. HCON updates cut tracking records and checkpointing.
4. HCON updates this "car/cut" record block with all information gathered during this state.
5. HCON informs OPCOM of master retarder control performance on this cut.

State 6
1. MASC informs HCON that the cut has exited the fan switching area.
2. HCON invokes the Exit Speed Calculator routine to compute this cut's desired exit speed from the known group retarder.
3. HCON informs the MARC group module of this cut's desired exit speed from the retarder.
4. HCON informs the MASC group module of the approaching cut.
5. HCON updates this "car/cut" record block with all information gathered during this state.
6. HCON prepares for checkpointing performance of processing of MARC and MASC modules (i.e. States 7 and 8).

State 7
1. MARC informs HCON that the cut has arrived at the group retarder.
2. HCON updates cut tracking records and checkpointing.

State 8
1. MARC informs HCON that the cut has exited the group retarder.
2. MASC informs HCON that the cut has entered the group switching area.

3. HCON updates cut tracking records and performs checkpointing.
4. HCON updates this "car/cut" record block with all information gathered during this state.
5. HCON informs OPCOM of group retarder control performance on this cut.

State 9

1. MASC informs HCON that the cut has exited the group switching area.
2. If the MADTC subsystem is configured to support automatic tuning of coupling speeds, then HCON informs MADTC of this cut so coupling speed scanning can be performed on this bowl track.
3. HCON updates this "car/cut" record block with all information gathered during this state.
4. HCON concludes tracking of this "car/cut" and reports all "car/cut" information to OPCOM for logging. HCON removes all records of this "car/cut".

In order to effect this functioning, HCON maintains two data structures, a car work block (one for each car that has arrived at the crest, and has not yet passed into a bowl track) and a cut work block (one for each cut) where the leading car of the cut has reached the crest, and the trailing car of the cut has not yet passed into the bowl areal. The information in each of these blocks is set forth below, Table 1 defines the information contained in the car work block, and Table 2 describes the information in the cut work block.

TABLE 1

| Car Work Block | |
|---|---|
| Car Sequence Number | The sequence number assigned to this car by HCON. |
| Cut Sequence Number | The sequence number assigned to this cut by HCON. |
| Crest Assigned Track | The destination track assigned to this car at the crest. |
| Front Truck Weight Class | The weight class of the front truck of this car as light, medium, heavy or extra heavy. |
| Rear Truck Weight Class | The weight class of the rear truck of this car as light, medium, heavy or extra heavy. |
| Car Height Class | The height class of the car as low, medium, high or extra high. |
| Car Axle Count | The number of axles counted on this car. |
| Car Direction | The direction of this car as sensed at the crest as either forward or backward. |
| Multi-Car Status | Is this car the first car of a cut? |
| Pointer to Next Car in Cut | Location of the car work block for the next car in this cut, if one exists. |

The cut work block is much more extensive, as it includes information respecting not only the make up of the cut and its destination, but also locations for performance information, i.e. how is the cut performed at the various regions in the yard, e.g. the crest, master retarder, fan switch, group retarders and group switches. While the car work block is completed by the time the car leaves the crest, in distinction, information is continually added to the cut work block until almost the time the cut leaves the control system.

TABLE 2

| Cut Work Block | |
|---|---|
| Cut Sequence Number | The sequence number assigned to this cut by HCON. |
| Crest Assigned Destination Track | The destination track assigned to the first car of the cut at the crest. |
| Actual Destination Track Routed To | The actual track the cut was routed to. |
| Front Truck Weight Class | The weight class of the front truck of the first car in the cut as light, medium, heavy or extra heavy. |
| Rear Truck Weight Class | The weight class of the rear truck of the first car in the cut as light, medium, heavy or extra heavy. |
| Cut Weight Class | The weight class of the cut as light, medium, heavy or extra heavy. |
| Cut Tonnage | Approximate weight in tons of cut. |
| Cut Height Class | The height class of the cut as low, medium, high or extra high. |
| Cut Axle Count | The number of axles in the cut. |
| Raw Rollability | The rollability of the cut as measured in the test section. |
| Cut Rollability Characteristics | The rollability of the cut after calculating factors such as weather. |
| Exit Speed Calculator Status Flags | Exit speed calculator flag byte. This bit records the fact that an arbitrary cut rollability characteristic was used. |
| Cut Length | Length of the cut in feet. |
| Crest Status Flags | Boolean flags describing what happened at the crest and the test section. The crest status flags consist of the following: |
| Long Cut Status | The cut was not free rolling before it actuated the first test section wheel detector. |
| Crest Wheel Detector Failure | Did a crest wheel detector fail? (True or False). |
| Test Section Wheel Detector Failure | Did a test section wheel detector fail? (True or False). |
| Weigh Rail Wheel Detector Failure | Did a weigh rail wheel detector fail? (True or False). |
| Backup Weigh Rail Used | Was the back up weigh rail used? (True or False). |
| Cut Light Detector Failure | Did the cut light detector fail? (True or False). |
| Temperature Class | The current temperature class as cold, warm or hot. |
| Current Control Area Number | If the cut is in a group area, is one of nine group areas; if the cut is in the region of the master retarder or their throat or fan switch area, then this number is 10. |
| Master Retarder Information | Various fields concerned with what was expected from the retarder, how it performed and the environment in which it was working. The master retarder information consists of the following: |
| Requested Retarder Exit Speed | The exit speed HCON requested. |
| Actual Retarder Exit Speed | The actual exit speed of the cut. |
| Actual Entry Velocity | The velocity of the cut as it entered the retarder. |
| Distance to Couple | Distance to couple for the cut currently under control. This value may be computed from the CTG (cars to go), and OPCOM sends the distance in feet or from the MADTC module, if present. |
| Wind Speed | Wind speed in feet per second (may be omitted). |
| Wind Direction | Wind direction. |
| Predicted Bowl Track Rolling Resistance | The predicted bowl track rolling resistance. |
| Retarder Status Flags | Predominantly Boolean flags used |

TABLE 2-continued

| Cut Work Block | |
|---|---|
| | to describe how the retarder functioned while controlling the cut and any exceptional events such as a catch up. The retarder status flags consist of the following: |
| Catcher | Did another cut catch up to this cut? |
| Catchee | Did this cut catch up to another cut? |
| Default Work Block | Did the retarder have to resort to default exit speeds? |
| Mode of Operation | What mode was the retarder in, (auto, manual, semi-auto)? |
| Radar 1 Failure | Did radar #1 fail? |
| Radar 2 Failure | Did radar #2 fail? |
| NWD Failure | Did the entrance wheel detector fail? |
| NLD Failure | Did the entrance light detector fail? |
| ILD Failure | Did the intermediate light detector fail? |
| XLD Failure | Did the exit light detector fail? |
| XWD Failure | Did the exit wheel detector fail? |
| Retarder Alarm | Did the retarder mechanism give the proper feedback to its control module? |
| Fan Switch Information | Information on how a cut was controlled by the switching system. The fan switch information consists of the following: |
| MASC Status Flags | Status of the MASC module in the fan area for a cut. |
| Number of Switches Travelled | The number of switches travelled over by the cut. |
| Switches Travelled | The identification of the switches the cut travelled over to get to its destination track. This information consists of the following: |
| Switch ID | Identification number for the switch. |
| Switch Status Condition Flags | Flags indicating the state of the switch and how it performed. |
| Arrival Time At Switch | Time cut arrived at the switch. |
| Group Retarder Information | Various fields concerned with what was expected from the retarder, how it performed, and the environment in which it was working. The group retarder information consists of the following. |
| Requested Retarder Exit Speed | The exit speed HCON requested. |
| Actual Retarder Exit Speed | The actual exit speed of the cut. |
| Actual Entrance Velocity | The velocity of the cut as it entered the retarder. |
| Distance to Couple | Distance to couple for the cut currently under control. This value may be computed from the cars to go (CTG), and OPCOM sends the distance in feet or from the MADTC module, if present. |
| Wind Speed | Wind speed in feet per second. |
| Wind Direction | Wind direction. |
| Predicted Bowl Track Rolling Resistance | The predicted bowl track rolling resistance. |
| Retarder Status Flags | Boolean flags used to describe how the retarder functioned while controlling the cut. The retarder status flags consist of the following: |
| Catcher | Did another cut catch up to this cut? |
| Catchee | Did this cut catch up to another cut? |
| Default Work Block | Did the retarder have to resort to default exit speeds? |
| Mode of Operation | What mode was the retarder in, (auto, manual or semi-auto)? |
| Radar #1 Failure | Did radar #1 fail? |
| Radar #2 Failure | Did radar #2 fail? |
| NWD Failure | Did the entrance wheel detector fail? |
| NLD Failure | Did the entrance light detector fail? |
| ILD Failure | Did the intermediate light detector fail? |
| XLD Failure | Did the exit light detector fail? |
| XWD Failure | Did the exit wheel detector fail? |
| Retarder Alarm | Did the retarder mechanism give the proper feedback to its control module? |
| Group Switch Information | Information on how a cut was controlled by the switching system. The group switch information consists of the following: |
| MASC Status Flags | Status of MASC module for a cut. |
| Number of Switches Travelled | Number of switches travelled over by the cut. |
| Switches Travelled | The switches the cut travelled over to get to its destination track. The switches travelled consist of the following: |
| Switch ID | Identification number for the switch. |
| Switch Status Condition Flags | Flags indicating the state of the switch and how it performed. |
| Arrival Time At Switch | Time the cut arrived at the switch. |
| Cut Tracking Information | Information on how the cut was processed throughout the entire system. As the cut progresses through the yard, this field is continually updated. This field can be used to determine what happened to the cut after the fact by a maintainer or analyst. Two status flags encode the status of the following: Flag 1 - Cut States Travelled Flag 2 - Messages Pertaining To Cut States (more than one message can be associated with a cut state). |
| Number Of Cars In This Cut | The number of cars in the cut. |
| Cut Sequence Number of Catcher | If a cut catches up to another cut the sequence number of the catcher is stored here in the catchee's work block. |
| Pointer to Catcher | Location of the catcher's cut work block. |
| Pointer to First Car in Cut | Location of the car work block for the first car in the cut. |

The HCON module also includes a queue of the cuts actually under control in any point in time. This data structure, "cuts in control queue", includes the following:

| | |
|---|---|
| Cuts in Control Queue | A list of all cuts currently under control by the control system. For each such cut, we store: |
| Cut Sequence Number | The sequence number for the cut. |
| Pointer to Cut Work Block | Location of the work block for this cut. |
| Pointer to Cuts in Control Queue | The location of the control queue for the next cut work block. |

Since HCON is the hub of the entire control system, the processing effected at HCON for car tracking and control purposes will now be described in connection with FIGS. 8–16. As will be seen, HCON receives messages from various other modules or subsystems, and in turn, after processing information, may formulate a message for other modules of subsystems. Thus, while HCON is normally active in the hump mode, it is actually driven by received information.

Figure 8:
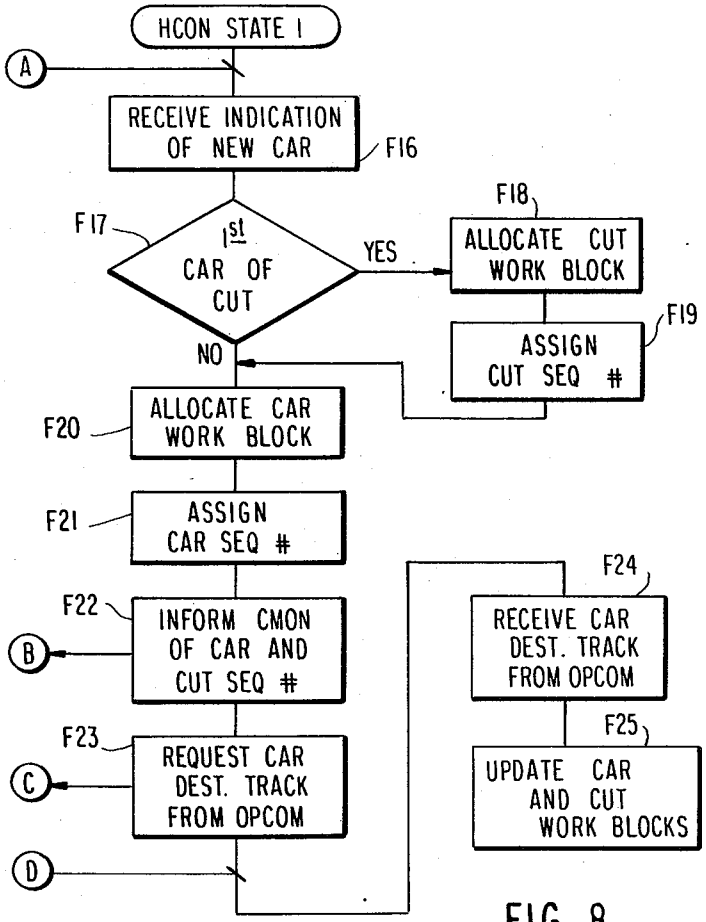
Figure 9:
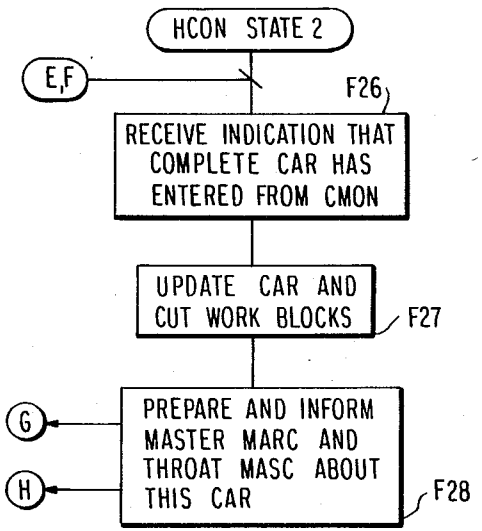
Figure 11:
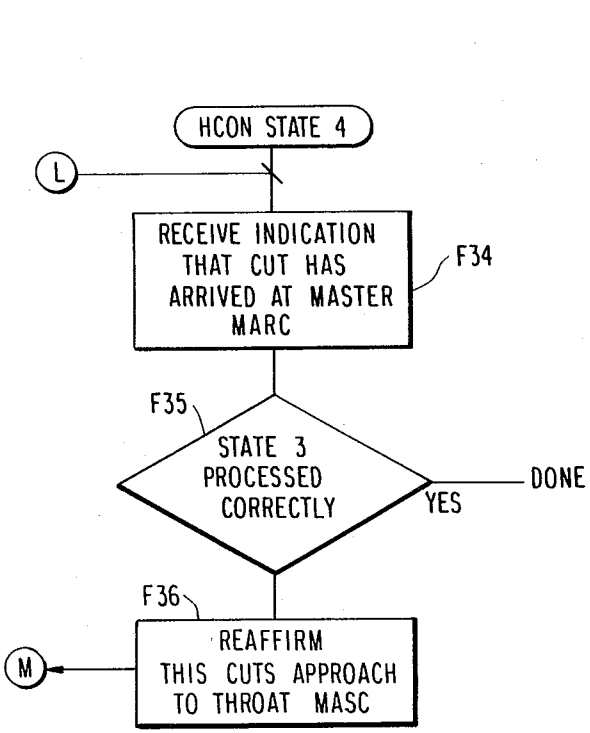

Referring now to FIG. 8, the processing effected by HCON in state 1 is shown. Actually, state 1 is initiated by the receipt of a message A, from CMON. In any event, function F16 receives an indication of a new car from CMON. Function F17 determines if this is the first car of a cut. This is effected by determining if there is an opened cut work block which has not yet been completed. Assuming this is the first car of a cut, then functions F18 and F19 allocate a cut work block to this new cut, and assign a cut sequence number. Function F20 allocates a car work block (it will be apparent that function F20 and the following functions are performed whether or not this is the first car of a new cut). Function F21 assigns a car sequence number. Function F22 then formulates a message B to CMON identifying to CMON the car and cut sequence number for this car. Function F23 requests a car destination track from OPCOM via a message C. At this point, HCON pauses, and will not continue until the requested information is received. That message, D, is received at function F24 with the destination track information. Function F25 updates the car and cut work blocks with the destination track information. That completes HCON processing in state 1.

State 2 (see FIG. 9) is initiated by a message E or F, again from CMON, indicating that the complete car has entered or passed the crest of the hump (see F26). Function F27 updates the car and cut work blocks and function F28 prepares a message to inform the master MARC and the throat MASC of this car, respectively messages G and H. That terminates the processing of HCON in state 2.

Figure 10:
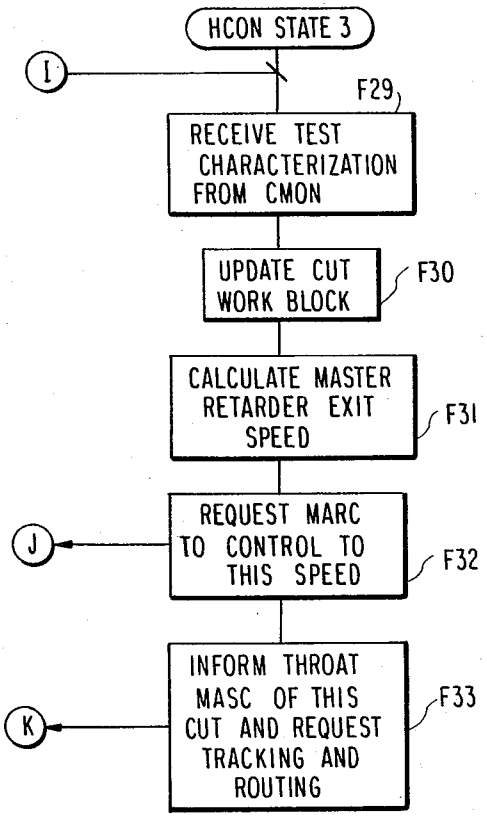
Figure 13:
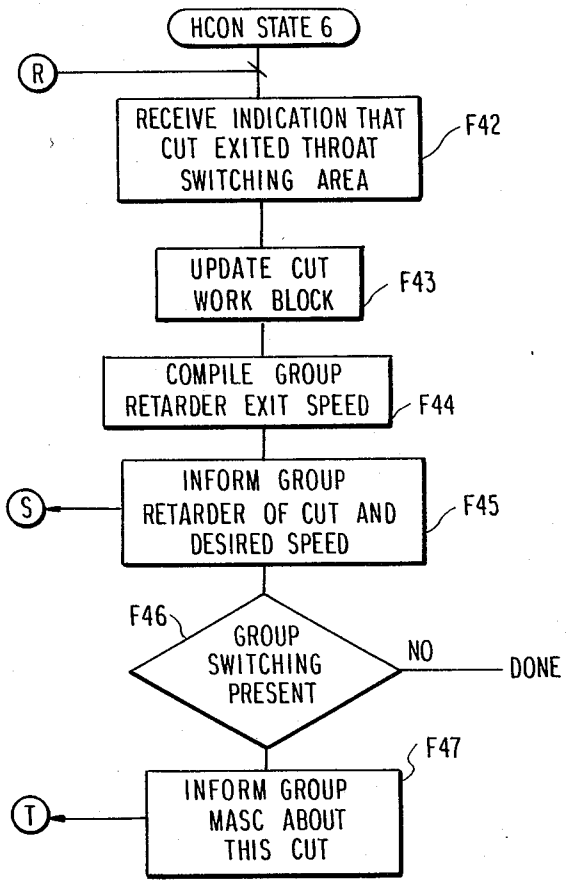

Referring now to FIG. 10, processing in state 3 is illustrated. This state begins with the receipt of a message, I, including the test section characterization information from CMON; that information is received at function F29. Function F30 uses this information to update the cut work block. Function F31 calculates the master retarder exit speed. This calculation requires knowledge of the distance the cut will have to travel between the tangent point of the bowl track to the preceding cut. MADTC, if present, informs HCON of changes in this distance, allowing HCON to maintain this information for each bowl track. Thus, no further action on the part of HCON is required to access this data. If MADTC is not present, a software module in OPCOM calculates CTG data which is transferred to HCON with the same effect. Function F32 formulates a message, J, to the master MARC, to control the cut to this calculated speed. Function F33 formulates a message, K, to the throat MASC, in forming the device of this cut, and requesting tracking and routing thereof. This concludes processing of HCON state 3.

State 4 (see FIG. 11) is indicated by a message, L, indicating the cut has arrived at the master MARC, see function F34. Function F35 determines if the previous state processing has been completed correctly, i.e. has message I (state 3) been received? If so, then function F35 terminates processing. On the other hand, function F36 formulates and transmits another message to the throat MASC, message K, reaffirming this cut's approach to the switch region. This terminates processing of state 4.

Figure 12:
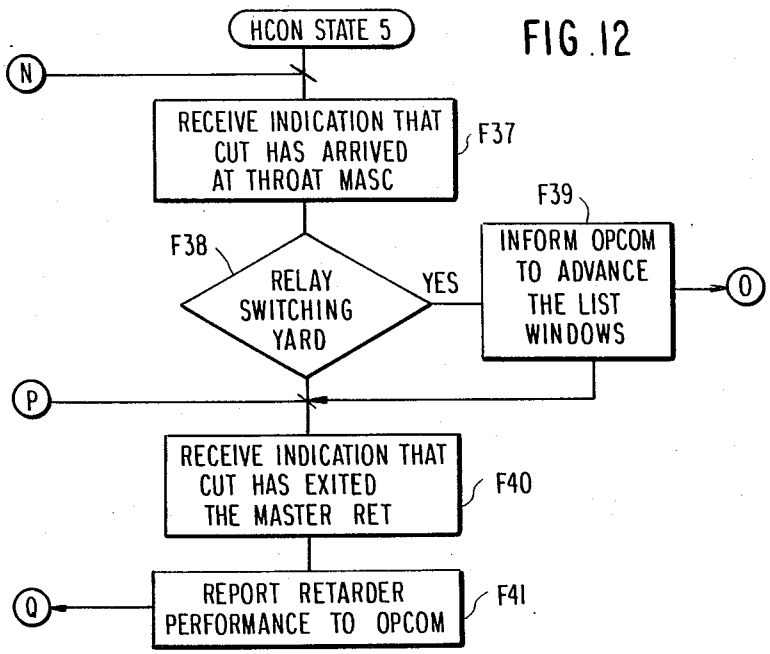

Referring now to FIG. 12, state 5 is initiated by the receipt of an indication (N) the cut has arrived at the throat MASC, see function F37. Function F38 determines if this is a relay switching yard. This determination is based on the software configuration. If this is such a relay switching yard, then function F39 formulates a message to OPCOM, O, to advance the consist list window, e.g. to display the next line or lines of the consist list. In the event that function F39 is not necessary, or after it has been performed, HCON awaits receipt of a message that the cut has existed the master retarder. This message P is received at function F40. Function F41 then uses the information received at message P, to report the retarder performance to OPCOM via message Q. If this is a relay switching yard, then function F41 also includes the step of deleting cut statistics from the HCON data base. This terminates HCON processing in state 5.

State 6 (see FIG. 13) is initiated by a message, R, indicating that the cut has exited the throat switching area, see function F42. Function F43 updates the cut work block. Function F44 compiles a group retarder exit speed. Function 45 uses this information to inform the selected group retarder of the cut in the desired exit speed via message S. Function F46 determines if group switching is present, e.g. is there a group switch region to be controlled. Again, this is a personalization input to HCON indicating yard configuration. The software is arranged so that the yard can be updated at any time, and by merely changing the personalization inputs, the software is available to handle the group switching function. If group switching is not available, then this terminates processing in state 6. On the other hand, if group switching is present, then a message T, is formulated to inform the group MASC about the approach of this cut.

Figure 14:
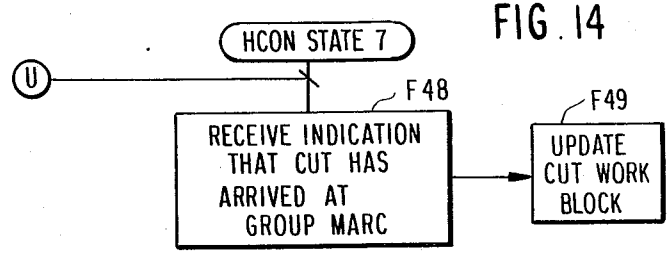

State 7 processing is shown in FIG. 14. This state is initiated by receipt of a message, U, indicating that the cut has arrived at the group MARC, see function F48. Function F49 updates the cut work block and this terminates processing in state 7.

Figure 15:
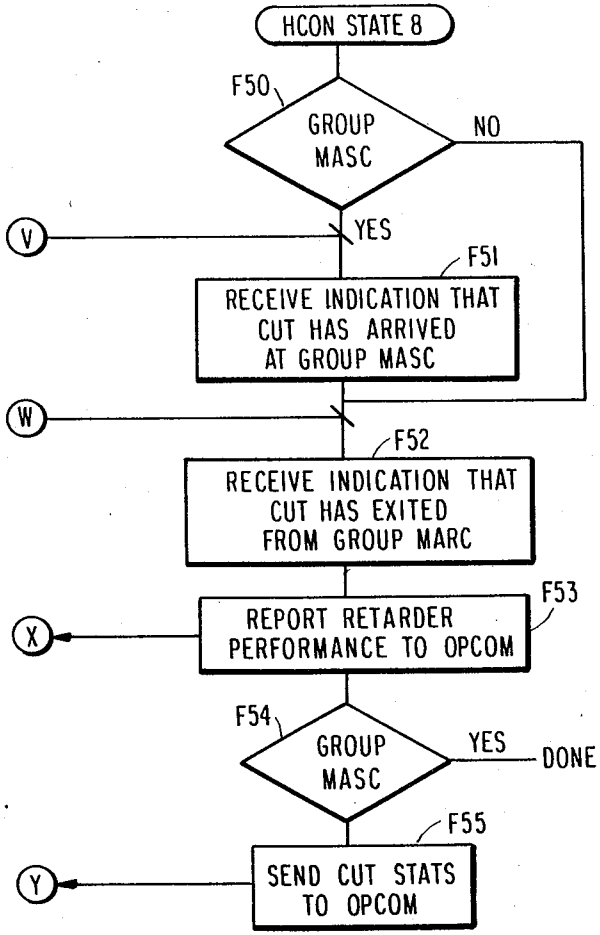
Figure 18:
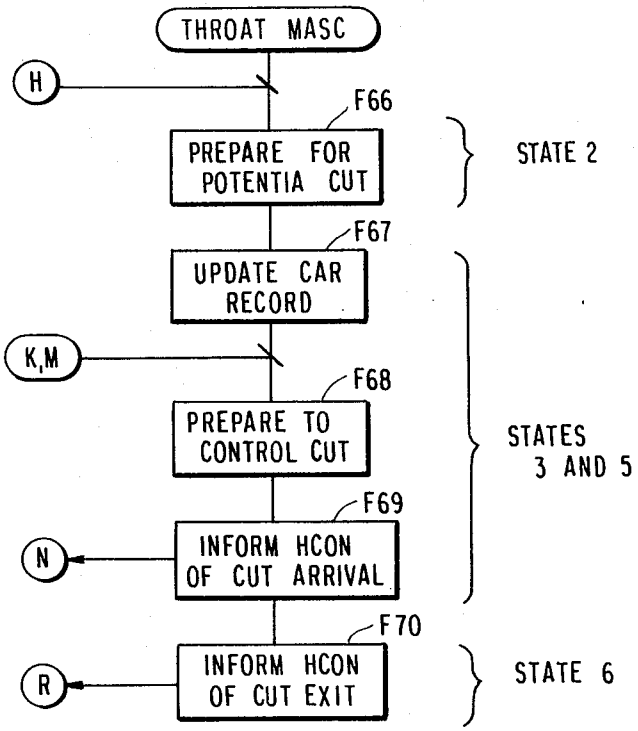

State 8 processing is shown in FIG. 15. Processing at this state can begin at one of two locations. If there is group switching present, then function F50 directs the software to halt for receipt of a message V, indicating that the cut has arrived at the group MASC, see function F51. Either after that function has been performed, or if it is unnecessary because there is no group switching in the yard, then the software awaits receipt of another message, W, indicating that the cut has exited from the group MARC, see function F52. Function F53 formulates a message to OPCOM, X, reporting retarder performance. Function F54 again branches depending on the presence of a group MASC. If there is such group switching, then function F54 terminates processing in state 8. On the other hand, if there is no such group switching then function F55 formulates a message, Y, sending cut statistics from HCON to OPCOM. In the absence of group switching, state 8 is the last processing state in HCON and therefore the cut statistics are transferred to OPCOM, since they are no longer necessary at HCON.

Figure 16:
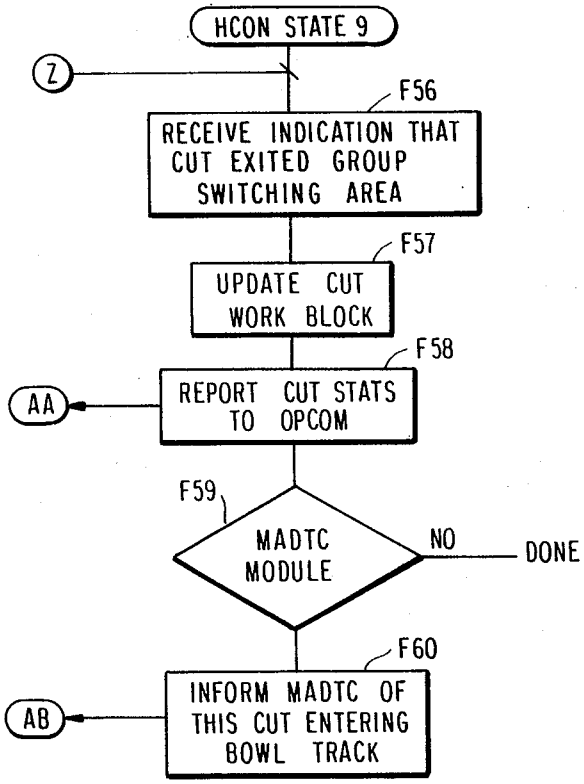

On the other hand, assuming the presence of group switching, then state 9 processing is shown in FIG. 16. A message, Z, initiates this processing indicating that the cut has exited from the group switching area, see function F56. Function F57 updates the cut work block and then function F58 reports the cut statistics to OPCOM via a message, AA. Function F58 also deletes the cut statistics from the HCON data base. Function F59 determines if there is a MADTC module, if there is none, that terminates processing in state 9. If there is a MADTC module, then function F60 informs the module via a message AB, of the cut entering the bowl track. This information is used in conjunction with a clearance track circuit to determine whether to resume or inhibit coupling speed scanning.

Figure 6:
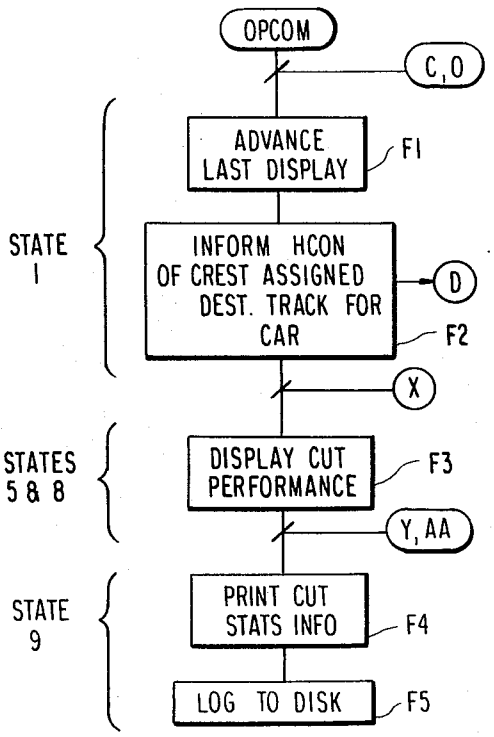

From the point of view of interfacing with car processing functions, OPCOM has relatively few functions, see FIG. 6. OPCOM can be initiated by receipt of a message, either C or O, and this causes OPCOM to advance the consist list display, function F1. Function F2 formulates a message to HCON, D, informing HCON of the crest assigned destination track for this car. Thereafter, OPCOM awaits receipt of a message X, and on receipt of that message displays cut performance, function F3. Again thereafter, OPCOM awaits receipt of a message, either Y or AA, and on receipt of that message, function F4 prints cut statistics, and function F5 logs the information to a mass memory device.

Figure 7:
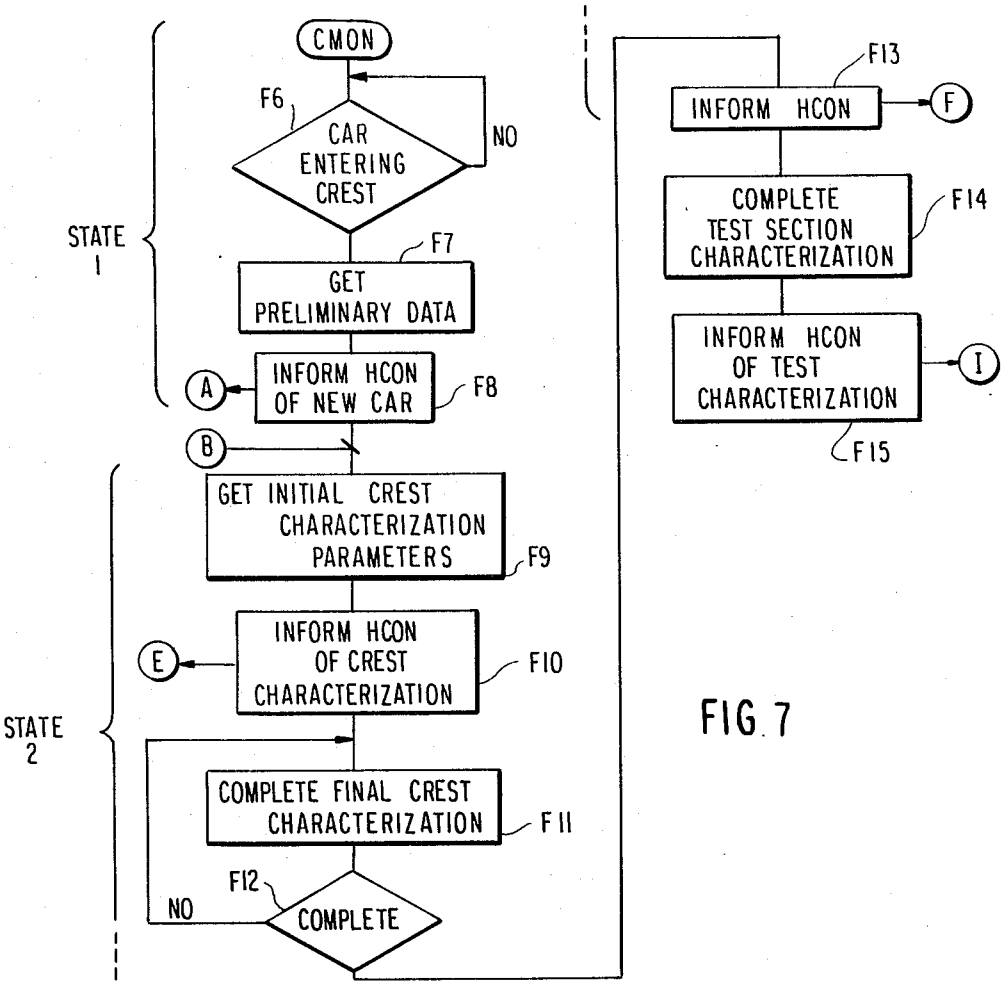
FIGS. 6–21 describe portions of the associated software, particularly those software elements which are used to interrelate the various modules employed in actually tracking and controlling a railroad car, as follows.

The crest monitor (CMON) software is shown in FIG. 7. That software is initiated by a transducer detecting a car entering a crest. Function F6 makes this determination, and in the absence of a car, CMON loops a waiting car entrance. When a car is detected as entering, function F7 obtains preliminary data from the associated transducers, at least enough initial information to inform HCON of the presence of a new car. When that information is available, a message, A, is formulated, function F8, and transmitted to HCON. Thereafter, CMON awaits receipt of a message B, from HCON. When that message is received, function F9 gets additional information, e.g. crest characterization parameters, and function F10 formulates a message, E, for HCON, containing this information. Function F11 adds additional crest characterization parameters from associated transducers and function F12 checks to see if the crest characterization is complete. If not, the loop of functions F11 and F12 is performed until the information is complete. When that is the case, function F13 formulates a message, F, to transmit that information to HCON. Thereafter, function F14 completes the test section characterization and function F15 formulates and transmits another message, I, informing HCON of the test section characterization of the cut.

Figure 17:
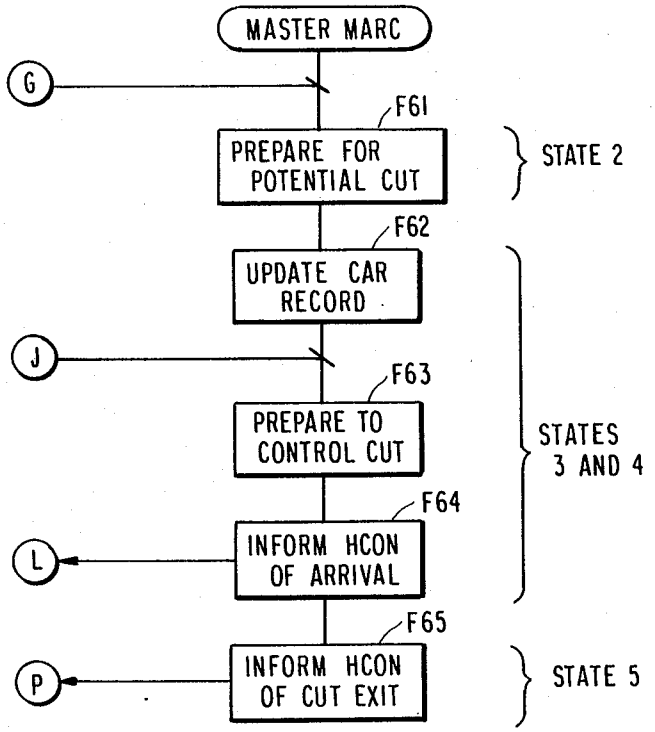

FIG. 17 illustrates the functions of the master MARC (controlling the master retarder). This processing is initiated on the receipt of a message, G, calling attention to the approach of a cut, see F61. Function F62 updates the car record at the local processor. Thereafter, processing awaits for receipt of the next message, J, and function F63 in response to it prepares the retarder to control the approaching cut. When the associated transducers acknowledge the presence of the cut at the master retarder, F64 formats an appropriate message, L, to HCON. Similarly, after the cut exits the master retarder, function F65 formats a message, P, informing HCON that the cut has exited the retarder.

The processing at the throat MASC (or switch controller) is essentially similar (functions F66–F70) and the specific messages received by the throat MASC, H, K and M, as well as the messages formatted and transmitted from the throats MASC, N and R are of course different from the messages used with the MARC software.

Figure 19:
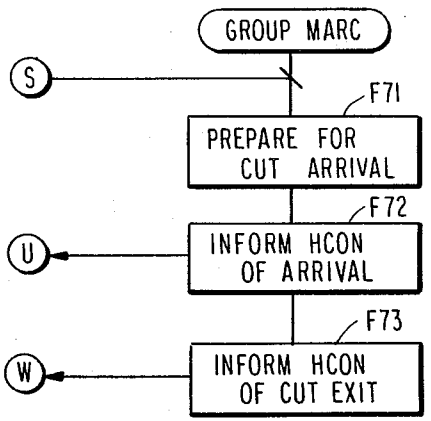
Figure 20:
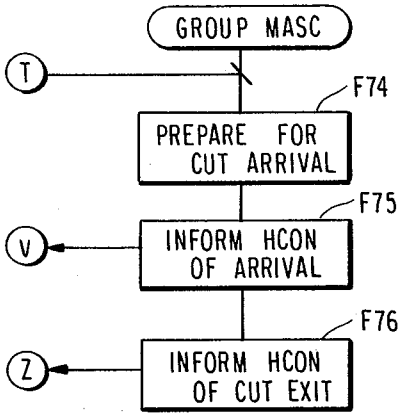
Figure 21:
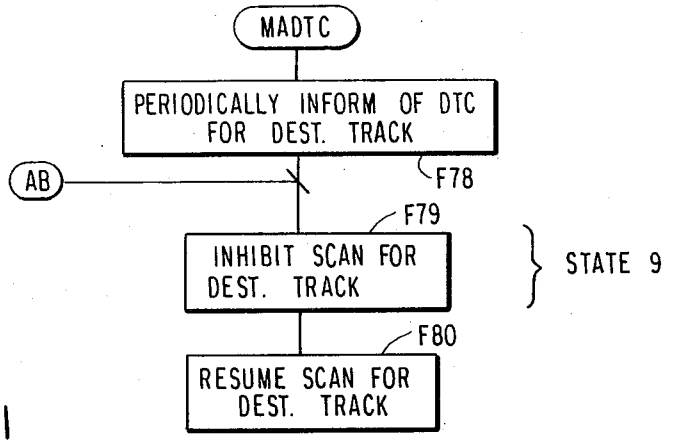

FIGS. 19 and 20 illustrates the processing at the group retarder (MARC) and the group switching area (MASC). In view of the preceding discussion, a detailed description of this processing is not believed necessary.

Since all of the messages which are passed among the various processors are either directed to or from HCON, we can discuss how HCON handles messages, and each of the messages will therefore be treated. Each message formatted by HCON for transmission includes an address. Since HCON can transmit on at least three different ports (to OPCOM, to MDCOM 122 or MDCOM 126) the address is used within HCON to determine through which port the transmission will be effected. Obviously, for those transmissions to OPCOM, no further switching is necessary, since those messages are directly received by OPCOM. On the other hand, the messages destined for any of the other modules are retransmitted (by the appropriate MDCOM) on its attached serial highway. In the reverse message, e.g. messages destined for HCON, obviously no switching is necessary, since all messages are destined for HCON. On the other hand, it is necessary for the message to be accompanied by an indication of which module transmitted the message, so that HCON can properly interpret the message. As is indicated, messages destined for modules connected to the serial highways 122S or 126S are potentially received by each of the other modules also attached to the same highway. However, the modules are personalized, at least by the back plane location in which they are located, so that only the appropriate module recognizes its address. Similarly, the same personalization enables the transmitting module to include its own identification in the message.

Although there is only a single master MARC and a single throat MASC, there may well be plural group MARC's and group MASC's. The personalization for each of the group MARC's and group MASC's include not only its function, e.g. MASC or MARC, but also its particular location, e.g. which group retarder or which group switching area. This addressing information is included in the message to HCON so that HCON can differentiate between one group retarder and another, or one group switching area and another.

The HCON software includes branch points depending on the presence of the MADTC module (see function F59) and the presence of group switching (see function F54). The information necessary to make the appropriate branch points is another personalization input which may for example be a dip switch so that if a system is installed which does not include the MADTC module, that module can be thereafter added, and when the appropriate dip switch position is reversed to reflect the presence of the MADTC module, the software is automatically enabled to handle the presence of the DTC module. Similar remarks apply to group switching.

The processing described in FIGS. 6–21 illustrates the processing required by the distributed nature of the control system, e.g. the processing illustrates how the necessary information is transmitted from a location at which the information is either generated or present, to a location which requires use of that information. The detailed processing necessary for control of a retarder or a group of switches is not illustrated, reference for that information being made to U.S. Pat. Nos. 3,844,514 and 3,865,042.

Figure 3:
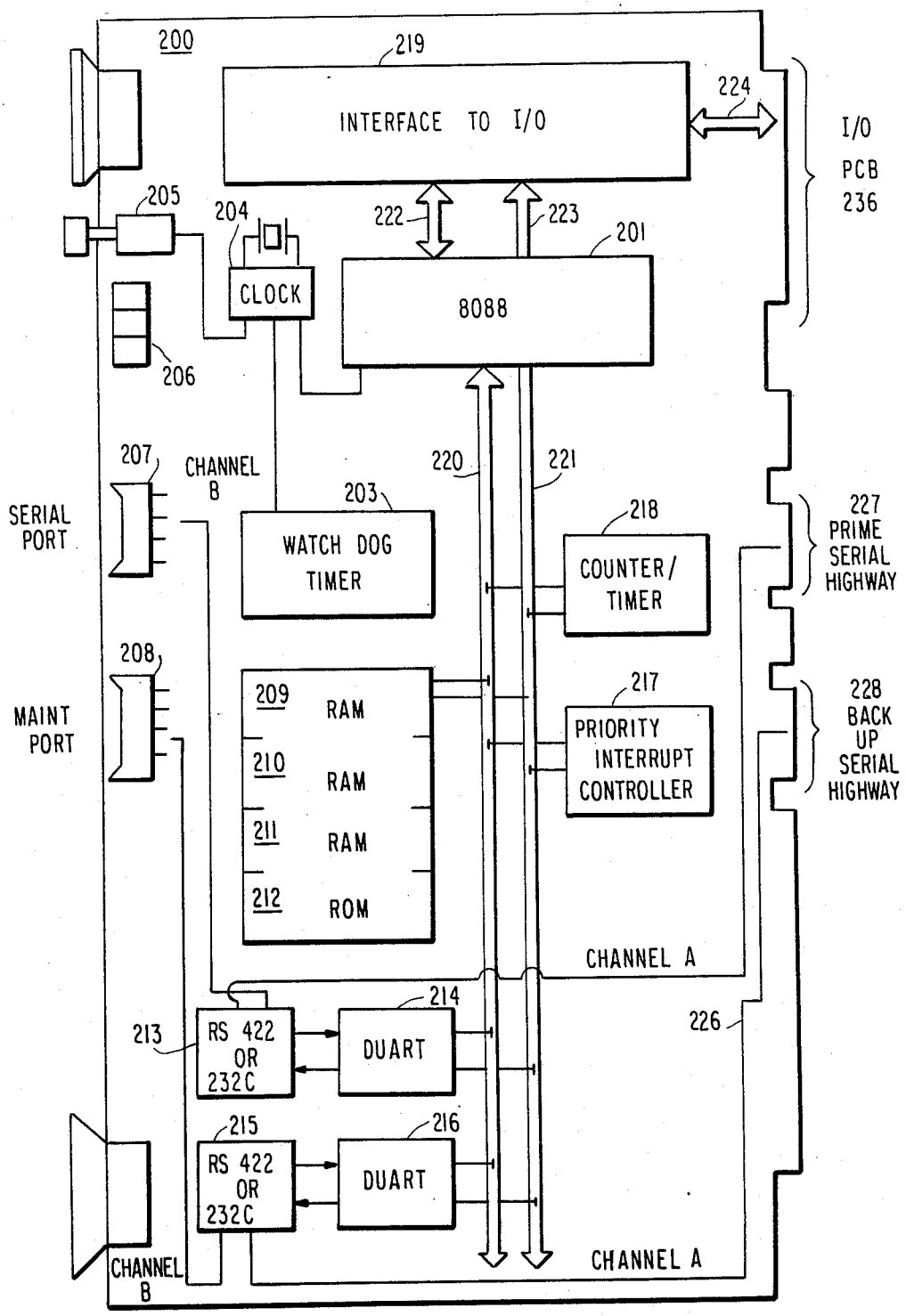
FIG. 3 is a detail block diagram of subsystem components including microprocessor chips.

As is indicated above, the modules making up subsystems CMON, MASC, MADTC, MARC and MDCOM include one or more microprocessors and related peripherals (except for MDCOM which does not require any peripherals), one microprocessor per module. The microprocessor in each module in these subsystems is supported on a PC board 200 such as that illustrated in FIG. 3. More particularly, the microprocessor 201 is coupled via data bus 220 and address bus 221 to a number of peripherals mounted on the PC board 200. These peripherals include a counter/timer 218, a priority interrupt controller 217, RAM 209–211 and ROM 212, and a pair of dual UART's 214 and 216. DUART 214 is coupled through a selectable RS 422 or RS 232C translator 213 to a pair of serial ports 207 and 208. These serial ports are not normally used in any of the mentioned subsystems except port 207, which is used by MDCOM to talk with HCON. On the other hand, the DUART 216 is coupled through an RS 422 or RS 232C translating circuit 215 to edge connectors 227 and 228, for coupling respectively to the prime serial highway, e.g. 122S or 126S, and the back up serial highway, e.g. 124S and 128S, respectively. Other elements on the PC board 200 include a clock 204 coupled to a reset pushbutton 205, and a watchdog timer 203. The microprocessor 201 is also coupled to a collection of interface circuits 219 (via data bus 222 and address bus 223) which is coupled to off-board peripherals, shown more particularly in FIGS. 4 and 5.

It will therefore be appreciated that the "intelligence" in each of the subsystems may be identical, with the only exception being the contents of ROMS 212. The commonality of the PC board 200 over a variety of subsystems is a substantial advantage of the invention.

Figure 4:
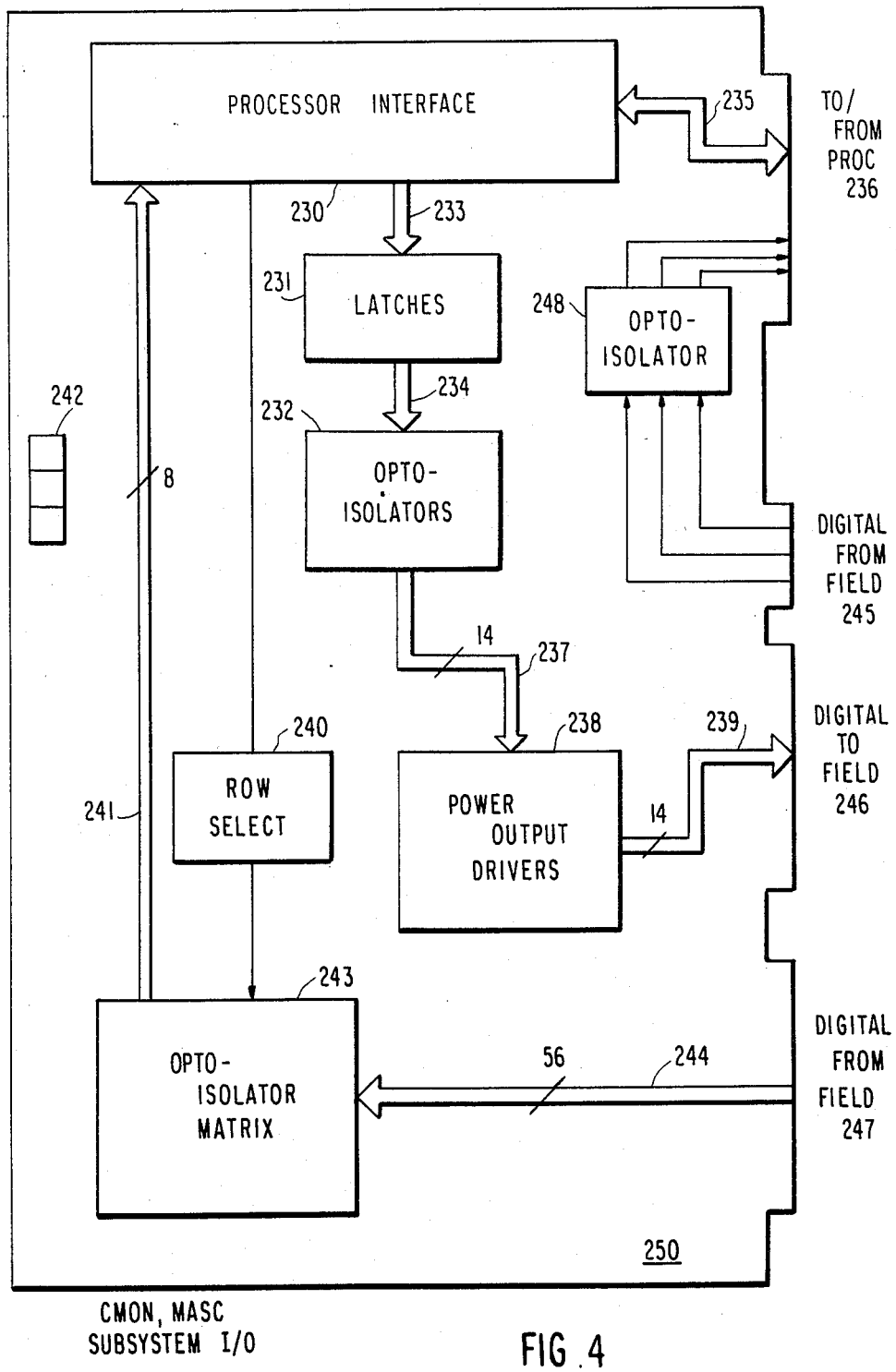
FIGS. 4 and 5 are detail block diagrams of two different types of interface elements for interfacing between field hardware and microprocessor elements.

Each module for the subsystems CMON and MASC includes an I/O interface PCB, which is shown in FIG. 4, as PCB 250. Included on the PCB 250 is a collection of interface circuits 230 coupled via a multiconductor bus 235 and contact pad terminal 236 to the associated microprocessor board 200. Outputs from this collection of interface circuits 230 is via a multiconductor bus 233 to a collection of latches 231 and 240. Output from the latches 231 is via multiconductor bus 234 to a collection of opto-isolators 232. The opto-isolators 232 feed a 16 conductor bus 237 into a set of power output drivers 238, one for each conductor in the bus. The output of the power output drivers 238 is coupled via another multiconductor bus 239 to a set of terminal contacts 246. Via this path, digital commands are output to field hardware. In the case of the CMON subsystem, these outputs include control of the hump signal and weigh rail transducer, for the MASC subsystem, these outputs can be used to throw a track switch.

The PC board 250 also provides for inputs, via a multipad terminal 247, and multiconductor bus 244 to an opto-isolator matrix 243. The digital inputs can be selected for reading via the row select (latch) circuit 240, from the processor interface 230. Outputs from the opto-isolator matrix 243 are coupled over multiconductor bus 241 to the processor interface 230. Also output from the contact pads terminal 236 are several signals derived from opto-isolator 248. The inputs to this opto-isolator 248 are digital inputs received at contact pad terminal 245. This specific signal path is provided for interrupts from CMON field hardware.

Figure 5:
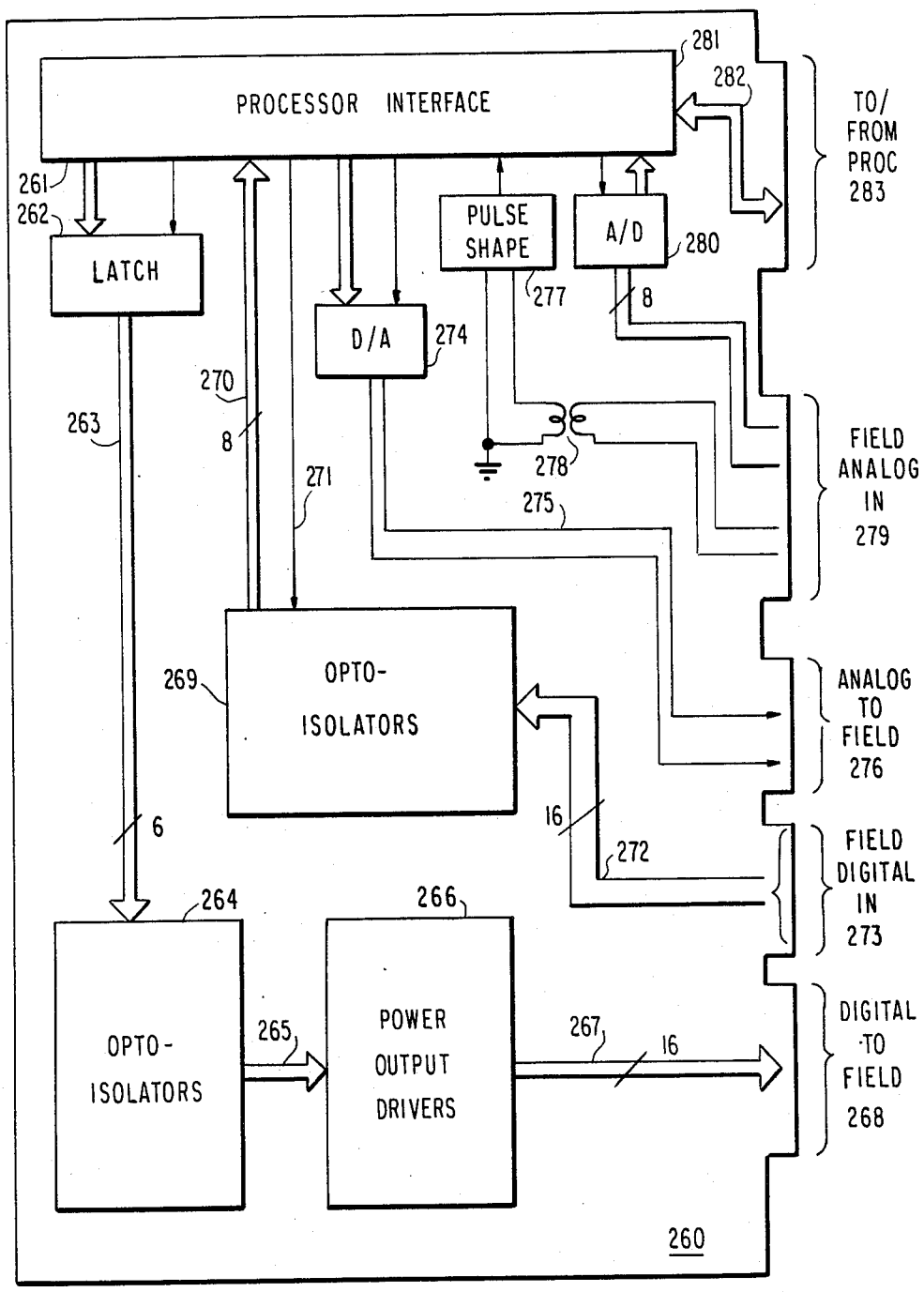

PC board 250 thus illustrates the I/O interface PCB for subsystems other than the MARC and MADTC. The I/O interface PCB for the MARC subsystem is shown in FIG. 5 as PCB 260. Digital inputs are handled by contact pads in terminal 273, bus 272, opto-isolators 269 and bus 270 to the processor interface 281. Digital outputs to the field are coupled from processor interface 281, to latch 262 (providing 16-bit output), multiconductor bus 263, opto-isolator 264, bus 265, power output drivers 266, bus 267 to the contact pads in terminal 268. Analog inputs from the field are coupled via the contact pads in terminal 279, either through optical coupler 278 and pulse shaper 277, or through A/D converter 280. The pulse shaper 277 is specifically provided for radar inputs. Analog outputs to the field are derived from processor interface 281 through D/A converter 274 through conductors 275 to the contact pads at terminal 276.

The processor interface 281 is coupled via bus 282, and the contact pads at terminal 283 to the PCB 200, and specifically the contact pads at terminal 236.

The OPCOM and HCON processors are based on industry standard microprocessors, in one embodiment Digital Equipment Corp. LSI 11/73.

We claim:

1. A control system for a railroad classification yard including a hump track, a master retarder located in said hump track, a plurality of group tracks connected to said hump track by track switches, each said group track including a group retarder, and a plurality of bowl tracks connected to said group tracks by track switches, said control system comprising:

(a) a hump control module including a microprocessor and related peripheral circuits;

(b) an operator communication module coupled to said hump control module, including a microprocessor and related peripheral circuits for transferring information to said hump control module;

(c) a retarder control subsystem including a retarder control module for each of said retarders, each said module including a microprocessor and related peripheral circuits;

(d) a switching control subsystem including a separate switch control module for each group of said track switches, each said module including a microprocessor and related peripheral circuits;

(e) a crest monitor module including a microprocessor and related peripheral circuits for generating information respecting characteristics and performance of a railroad car or cars traversing a crest of said hump;

(f) a communication subsystem comprising a plurality of communication modules for respectively interconnecting said hump control module with said crest monitor module, each of said retarder control modules and each of said switch control modules; each of said communication modules comprising a microprocessor and dedicated communication link.

2. The apparatus of claim 1 in which said hump control module maintains a data base including:

axle count data, weight data and destination track information.

3. The apparatus of claim 1 which said hump control module maintains a data base including:

axle count data, weight data and destination track data in the form of:

a multi-entry car work block for each car, a multi-entry cut work block for each cut.

4. The apparatus of claim 2 or 3 in which:

said crest monitor module generates data for said data base and transmits said data to said hump control module.

5. The apparatus of claim 4 which said operator communication module transmits destination track data to said hump control module for said data base.

6. The apparatus of claim 5 in which said hump control module tracks travel of a car and transmits portions of said data base to switch and retarder control modules.

7. The apparatus of claim 3 in which said hump control module includes means responsive to a cut reaching a predetermined location for clearing associated car and cut work blocks and transmitting data contained therein to said operator control module.

8. The apparatus of claim 1 which further includes a distance to couple module for measuring free distances on said bowl tracks and reporting to said hump control module.

9. A control system for a railroad classification yard including a hump track, a master retarder located in said hump traok, a plurality of group tracks connected to said hump track by track switches, each said group track including a group retarder, and a plurality of bowl tracks connected to said group tracks by track switches, said control system comprising:

(a) a hump control module for maintaining a data base respecting railroad cars traversing said yard, transferring and receiving information respecting railroad car position and performance, said hump control module comprising a microprocessor and related peripheral circuits;

(b) an operator communication module coupled to said hump control module, said operator communication module including at least one peripheral circuits for reception of information and a microprocessor responsive to said peripheral circuits for transferring at least some of said information to said hump control module;

(c) a retarder control subsystem including a retarder control module for each of said retarders, each of said retarder control modules including a microprocessor and associated peripheral circuits;

(d) a crest monitor module including a microprocessor and related peripheral circuits for generating information respecting a particular RR car or cars then traversing a crest of said hump;

(e) a comnunication subsystem comprising a plurality of communication modules for respectively interconnecting said hump control module with said crest monitor module and each of said retarder control modules; each of said communication modules including a microprocessor and a dedicated communication link.

10. The apparatus of claim 9 in which said data base includes:

axle count data and weight data.

11. The apparatus of claim 9 in which said data base includes:

axle count data and weight data in the form of:

a multi-entry car work block for each car, a multi-entry cut work block for each cut.

12. The apparatus of claim 9 or 10 in which:

said crest monitor module generates data for said data base and transmits said data to said hump control module.

13. The apparatus of claim 12 in which said hump control module tracks travel of a car and transmits portions of said data base to one of said retarder control modules.

14. The apparatus of claim 13 in which said hump control module includes means responsive to a cut reaching a predetermined location for clearing associated car and cut work blocks and transmitting data contained therein to said operator communication module.

15. The apparatus of claim 9 which further includes a distance to couple module for measuring free distances on said bowl track and reporting to said hump control module.

16. A control system for a railroad classification yard including a hump track, a master retarder located in said hump track, a plurality of group tracks connected to said hump track by track switches, each said group track including a group retarder, and a plurality of bowl tracks connected to said group tracks by track switches, said control system comprising:

(a) a hump control module for maintaining a data base respecting railroad cars traversing said yard, transferring and receiving information respecting railroad car position and performance, said hump control module comprising a microprocessor and related peripheral circuits;

(b) an operator communication module coupled to said hump control module, said operator communication module including at least one peripheral circuits for reception of information and a microprocessor responsive to said peripheral circuits for transferring at least some of said information to said hump control module;

(c) a retarder control subsystem including a retarder control module for each of said retarders, each of said retarder control modules including a microprocessor and associated peripheral circuits;

(d) a switching control subsystem including a separate switch control module for each group of said switches, each of said switch control modules including a microprocessor and related peripheral circuits;

(e) a crest monitor module including a microprocessor and related peripheral circuits for generating inforamtion respecting a particular railroad car or cars then traversing a crest of said hump;

(f) a communication subsystem comprising a plurality of communication modules for respectively interconnecting said hump control module with said crest monitor module, each of said retarder control modules and each of said switch control modules; each of said communication modules including a microprocessor and a dedicated communication link.

17. The apparatus of claim 16 in which said data base includes:

axle count data, weight data and destination track information.

18. The apparatus of claim 16 in which said data base includes:

axle count data, weight data and destination track data in the form of:

a multi-entry car work block for each car, a multi-entry cut work block for each cut.

19. The apparatus of claim 17 or 18 in which:

said crest monitor module generates data for said data base and transmits said data to said hump control module.

20. The apparatus of claim 19 in which said operator communication module transmits destination track data to said hump control module for said data base.

21. The apparatus of claim 20 in which said hump control module tracks travel of a car and transmits portions of said data base to switch and retarder control modules.

22. The apparatus of claim 18 in which said hump control module includes means responsive to a cut reaching a predetermined location for clearing associated car and cut work blocks and transmitting data contained therein to said operator communication module.

23. A control system for railroad classification yard including a hump track, a master retarder located in said hump track, a plurality of group tracks connected to said hump track by track switches, each said group track including a group retarder, and a plurality of bowl tracks connected to said group tracks by track switches, said control system comprising: base a. a hump control module for maintaining a data base respecting railroad cars traversing said yard, transferring and receiving information respecting railroad car position and performance, said hump control module comprising a hump control microprocessor and related peripheral circuits, said hump control microprocessor located on a printed circuit board, b. an operator communication module coupled to said hump control module, said operator communication module including at least one peripheral circuits for reception of information and an OPCOM microprocessor responsive to said peripheral circuits for transferring at least some of said information to said hump control module; said operator communication module including said OPCOM microprocessor located on a printed circuit board, c. a retarder control subsystem including a retarder control module for each of said retarders, each of said retarder control modules including a MARC microprocessor and associated peripheral circuits, said MARC microprocessor located on a printed circuit board, d. a crest monitor module including a CMON microprocessor and related peripheral circuits for generating information respecting a particular railroad car or cars, then traversing a crest of said hump, said CMON microprocessor located on a printed circuit board, and e. a communication subsystem comprised of a plurality of communication modules for respectively interconnecting said hump control module with said crest monitor module and each of said retarder control modules, each of said communication modules including a MDCOM microprocessor and a dedicated communication link between said hump control module and at least one other module; each of said MDCOM microprocessors associated with said communication modules located on a printed circuit board, wherein f. said printed circuit board in said retarder control subsystem, communications subsystem and crest monitor module are identical.

24. The apparatus of claim 23 which further includes:

a switching control subsystem including a switching control module for each group of said switches, each of said switching control modules including a MASC microprocessor and associated peripheral circuits, said MASC microprocessor located on a printed circuit board.

25. The apparatus of claim 24 in which said printed circuit board in said switching control subsystem is identical to the printed circuit boards in said retarder control subsystem.

26. The apparatus of claim 23 in which said data base includes:

axle count data, weight data and destination track information.

27. The apparatus of claim 23 in which said data base includes:

axle count data, weight data and destination track data in the form of:

a multi-entry car work block for each car, a multi-entry cut work block for each cut.

28. The apparatus of claim 26 or 27 in which:

said crest monitor module generates data for said data base and transmits said data to said hump control module.

29. The apparatus of claim 28 in which said operator communication module transmits destination track data to said hump control module for said data base.

30. The apparatus of claim 29 in which said hump control module tracks travel of a car and transmits portions of said data base to switch and retarder control modules.

31. The apparatus of claim 27 in which said hump control module includes means responsive to a cut reaching a predetermined location for clearing associated car and cut work blocks and transmitting data contained therein to said operator control module.

32. The system of claim 1 or 16 or 24 in which said communications subsystem includes:

a first communication module interconnecting said hump control module with said crest monitor module and said switch control modules, in which said crest monitor module and said switch control modules are coupled in parallel, and a second communication module interconnecting said hump control module with said retarder control modules.

* * * * *